US010297192B2

(12) United States Patent
Lee et al.

(10) Patent No.: US 10,297,192 B2
(45) Date of Patent: May 21, 2019

(54) LIGHT EMITTING DISPLAY DEVICE AND METHOD FOR DRIVING THE SAME

(71) Applicant: LG Display Co., Ltd., Seoul (KR)

(72) Inventors: YongKon Lee, Seoul (KR); Young-Mee Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/710,677

(22) Filed: Sep. 20, 2017

(65) Prior Publication Data

US 2018/0096649 A1 Apr. 5, 2018

(30) Foreign Application Priority Data

Sep. 30, 2016 (KR) ..... 10-2016-0126487

(51) Int. Cl.

| | |
|---|---|
| ***G09G 5/00*** | (2006.01) |
| ***G09G 3/3208*** | (2016.01) |
| ***G09G 3/3233*** | (2016.01) |
| ***G09G 3/3291*** | (2016.01) |

(52) U.S. Cl.

CPC ..... *G09G 3/3208* (2013.01); *G09G 3/3233* (2013.01); *G09G 3/3291* (2013.01); *G09G 2320/0233* (2013.01); *G09G 2320/0295* (2013.01); *G09G 2320/043* (2013.01); *G09G 2320/045* (2013.01); *G09G 2320/0633* (2013.01); *G09G 2330/021* (2013.01)

(58) Field of Classification Search

CPC .. G09G 3/3208; G09G 3/3233; G09G 3/3291; G09G 2320/021; G09G 2320/0233; G09G 2320/0295; G09G 2320/043; G09G 2320/045; G09G 2320/0633

See application file for complete search history.

(56) References Cited

U.S. PATENT DOCUMENTS

| | | | | |
|---|---|---|---|---|
| 8,358,299 | B2 * | 1/2013 | Chaji | G09G 3/3233 345/211 |
| 9,940,871 | B2 * | 4/2018 | Lee | G01R 31/2635 |
| 2005/0088379 | A1 * | 4/2005 | Tsuchida | G09G 3/3258 345/76 |
| 2005/0237318 | A1 * | 10/2005 | Inoue | G09G 5/003 345/207 |

(Continued)

*Primary Examiner* — Joe H Cheng
(74) *Attorney, Agent, or Firm* — Polsinelli PC

(57) ABSTRACT

A light emitting display device and a method for driving the same are disclosed, in which a source voltage of a driving transistor for compensating for degradation of a light emitting element may be prevented from getting out of a sensing voltage range of an analog-to-digital converter. The light emitting display device comprises a display panel connected to data lines, scan lines and reference voltage lines and provided with pixels, each pixel including a light emitting element; an analog-to-digital converter (ADC) converting voltages sensed from the pixels through the reference voltage lines into sensing data; and a voltage supply unit supplying a reference voltage to the reference voltage lines. The voltage supply unit supplies a third low voltage and a third high voltage to the ADC in a degradation compensation mode for compensating for degradation of the light emitting element. In the degradation compensation mode, the reference voltage is equal to or higher than the third low voltage.

20 Claims, 13 Drawing Sheets

(56) References Cited

U.S. PATENT DOCUMENTS

| | | | | |
|---|---|---|---|---|
| 2009/0051628 | A1* | 2/2009 | Kwon | G09G 3/3233 345/77 |
| 2010/0007656 | A1* | 1/2010 | Okamoto | G09G 3/3233 345/214 |
| 2010/0073335 | A1* | 3/2010 | Min | G09G 3/3233 345/204 |
| 2011/0122119 | A1* | 5/2011 | Bae | G09G 3/3233 345/211 |
| 2011/0157134 | A1* | 6/2011 | Ogura | G09G 3/20 345/211 |
| 2014/0160142 | A1* | 6/2014 | Lee | G09G 3/3208 345/589 |
| 2014/0176409 | A1* | 6/2014 | Kim | G09G 3/3233 345/92 |
| 2015/0243216 | A1* | 8/2015 | Chung | G09G 3/3233 345/214 |
| 2015/0379940 | A1 | 12/2015 | Kishi | |
| 2016/0111042 | A1 | 4/2016 | Pyeon | |
| 2016/0133172 | A1* | 5/2016 | Hwang | G09G 3/3233 324/762.07 |
| 2016/0163251 | A1 | 6/2016 | Kwon et al. | |
| 2016/0189618 | A1* | 6/2016 | Park | G09G 3/3233 345/690 |
| 2016/0189628 | A1 | 6/2016 | Choi | |
| 2016/0343302 | A1* | 11/2016 | Han | G09G 3/3233 |
| 2017/0067957 | A1* | 3/2017 | Lee | G01R 31/2635 |
| 2017/0124947 | A1* | 5/2017 | Kim | G09G 3/3233 |
| 2017/0132977 | A1* | 5/2017 | Kim | G09G 3/3225 |
| 2017/0132979 | A1* | 5/2017 | Oh | G09G 3/12 |
| 2017/0193881 | A1* | 7/2017 | Kim | G09G 3/2074 |
| 2017/0345377 | A1* | 11/2017 | Oh | G09G 3/3291 |

* cited by examiner

LIGHT EMITTING DISPLAY DEVICE AND METHOD FOR DRIVING THE SAME

CROSS REFERENCE TO RELATED APPLICATION

This application claims the benefit of the Korean Patent Application No. 10-2016-0126487 filed on Sep. 30, 2016, which is hereby incorporated by reference in its entirety for all purposes as if fully set forth herein.

BACKGROUND

Field of the Disclosure

The present disclosure relates to a display device, and more particularly, to a light emitting display device and a method for driving the same.

Description of the Background

With the development of information society, various demands for display devices for displaying picture images have been increased. In this respect, various display devices such as a liquid crystal display (LCD) device, a plasma display panel (PDP), and a light emitting display (EL) device have been recently used. Among them, the light emitting display device is characterized in low voltage driving, thin size, an excellent viewing angle and fast response speed.

The light emitting display device includes a display panel having data lines, scan lines and a plurality of sub pixels formed at crossing portions between the data lines and the scan lines, a scan driver supplying scan signals to the scan lines, and a data driver supplying data voltages to the data lines. Each of the sub pixels includes a light emitting element, a driving transistor, and a scan transistor. The driving transistor controls the amount of current supplied to the light emitting element in accordance with a voltage of a gate electrode. The scan transistor supplies the data voltage of the data line to the gate electrode of the driving transistor in response to the scan signal of the scan line.

A threshold voltage of the driving transistor varies per pixel due to process deviation during manufacture of the light emitting display device or degradation of the driving transistor, which is caused by long time driving. That is, if the same data voltage is applied to pixels, the same current should be supplied to the light emitting element. However, even though the same data voltage is applied to the pixels, the current supplied to the light emitting element may be varied per pixel due to a difference in threshold voltages of the driving transistors between the pixels. In addition, the light emitting element may be degraded due to long time driving. In this case, luminance of the light emitting element varies per pixel. Therefore, even though the same data voltage is applied to the pixels, luminance of the light emitting element may be varied per pixel. To solve this problem, a method for compensating for the threshold voltage and electron mobility of the driving transistor and degradation of the light emitting element has been suggested.

The threshold voltage and electron mobility of the driving transistor and degradation of the light emitting element can be compensated by an external compensation method. The external compensation method is to supply a predetermined data voltage to pixels, sense a source voltage of the driving transistor through a predetermined sensing line in accordance with a predetermined data voltage, convert the voltage sensed using an analog-to-digital converter to sensing data, and compensate for digital video data in accordance with the sensing data.

Meanwhile, if the sensing voltage range of the analog-to-digital converter may be equal both when the source voltage of the driving transistor is sensed to compensate for electron mobility of the driving transistor and when the source voltage of the driving transistor is sensed to compensate for degradation of the light emitting element. In this case, the source voltage of the driving transistor for compensating for degradation of the light emitting element may get out of a sensing voltage range of the analog-to-digital converter. Therefore, degradation of the light emitting element cannot be compensated normally.

SUMMARY

Accordingly, the present disclosure is directed to a light emitting display device and a method for driving the same, which substantially obviate one or more problems due to limitations and disadvantages of the related art.

An advantage of the present disclosure is to provide a light emitting display device and a method for driving the same, in which a source voltage of a driving transistor for compensating for degradation of a light emitting element can be prevented from getting out of a sensing voltage range of an analog-to-digital converter.

Additional advantages and features of the disclosure will be set forth in part in the description, which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a light emitting display device according to one aspect of the present disclosure comprises a display panel connected to data lines, scan lines and reference voltage lines and provided with pixels, each pixel including a light emitting element; an analog-to-digital converter (ADC) converting voltages sensed from the pixels through the reference voltage lines into sensing data; and a voltage supply unit supplying the reference voltage to the reference voltage lines, wherein the voltage supply unit supplies a third low voltage and a third high voltage to the ADC in a degradation compensation mode for compensating for degradation of the light emitting element. In the degradation compensation mode, the reference voltage is a voltage equal to or less than the third low voltage.

A method for driving a light emitting display device according to one aspect of the present disclosure comprises the steps of supplying a reference voltage to reference voltage lines; and sensing voltages in the pixels between a first low voltage and a first high voltage through the reference voltage lines in a degradation compensation mode for compensating for degradation of the light emitting element and outputting sensing data, wherein the reference voltage in the degradation compensation mode is equal to or less than the first low voltage.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the present disclosure and are incorporated in and constitute a part of this disclosure, illustrate aspect(s) of the disclosure and together with the description serve to explain the principle of the disclosure.

In the drawings.

DETAILED DESCRIPTION

Figure 1:
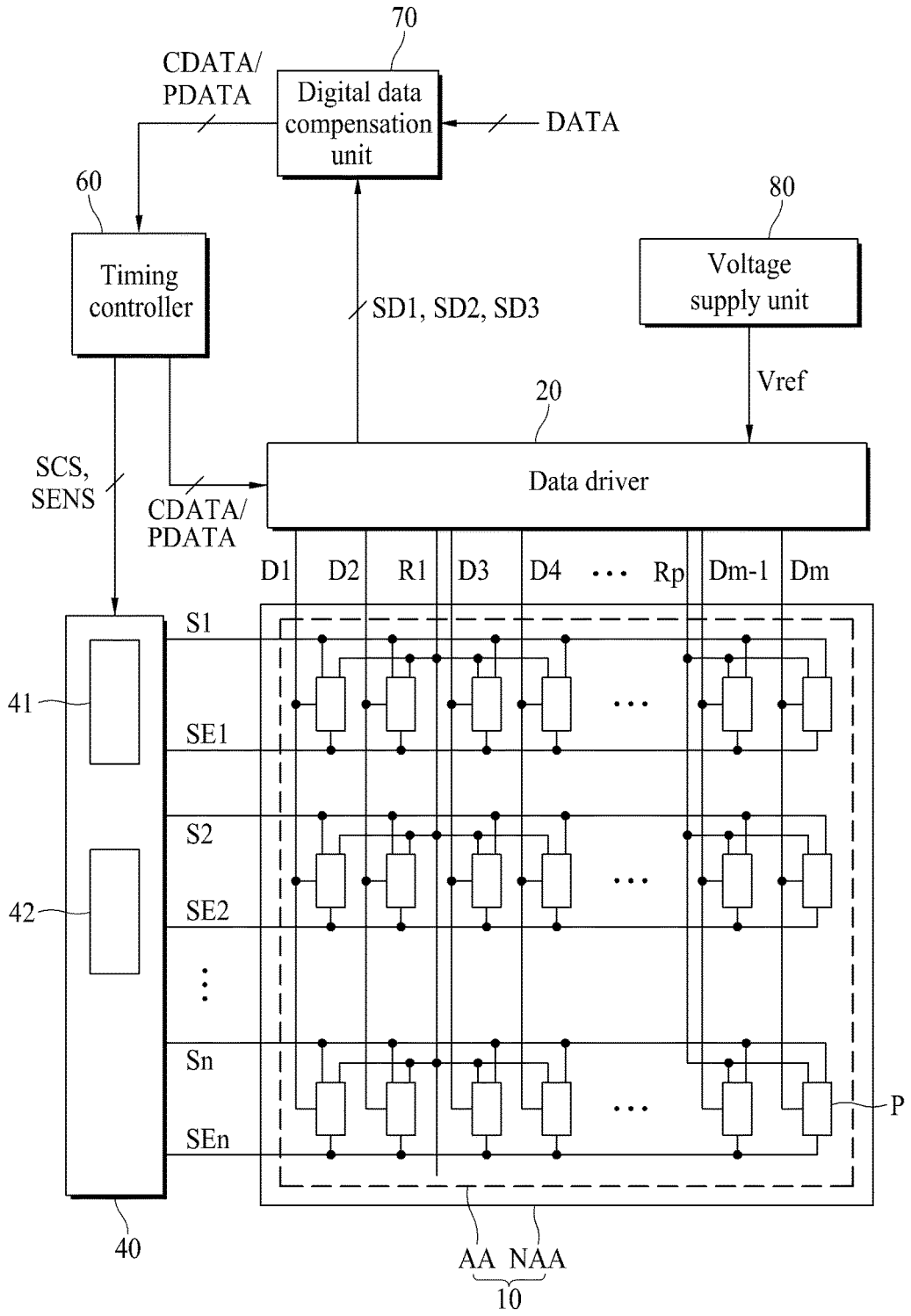
FIG. 1 is a block diagram illustrating a light emitting display device according to an aspect of the present disclosure.

The same reference numbers substantially mean the same elements through the specification. In the following description of the present disclosure, if detailed description of elements or functions known in respect of the present disclosure is not relevant to the subject matter of the present disclosure, the detailed description will be omitted. The terms disclosed in this specification should be understood as follows.

Advantages and features of the present disclosure, and implementation methods thereof will be clarified through following aspects described with reference to the accompanying drawings. The present disclosure may, however, be embodied in different forms and should not be construed as limited to the aspects set forth herein. Rather, these aspects are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing aspects of the present disclosure are merely an example, and thus, the present disclosure is not limited to the illustrated details. Like reference, numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when the position relationship is described as 'upon~', 'above~', 'below~', and 'next to~', one or more portions may be arranged between two other portions unless 'just' or 'direct' is used.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another element. Therefore, a first element could be termed a second element, and, similarly, a second element could be termed a first element, without departing from the scope of the present disclosure.

"X-axis direction", "Y-axis direction" and "Z-axis direction" should not be construed by a geometric relation only of a mutual vertical relation, and may have broader directionality within the range that elements of the present disclosure may act functionally.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various aspects of the present disclosure may be partially or overall coupled to or combined with each other, and may be variously inter-operated with each other and driven technically, as those skilled in the art can sufficiently understand. The aspects of the present disclosure may be carried out independently from each other, or may be carried out together in co-dependent relationship.

Hereinafter, the preferred aspects of the present disclosure will be described in detail with reference to the accompanying drawings.

Figure 2:
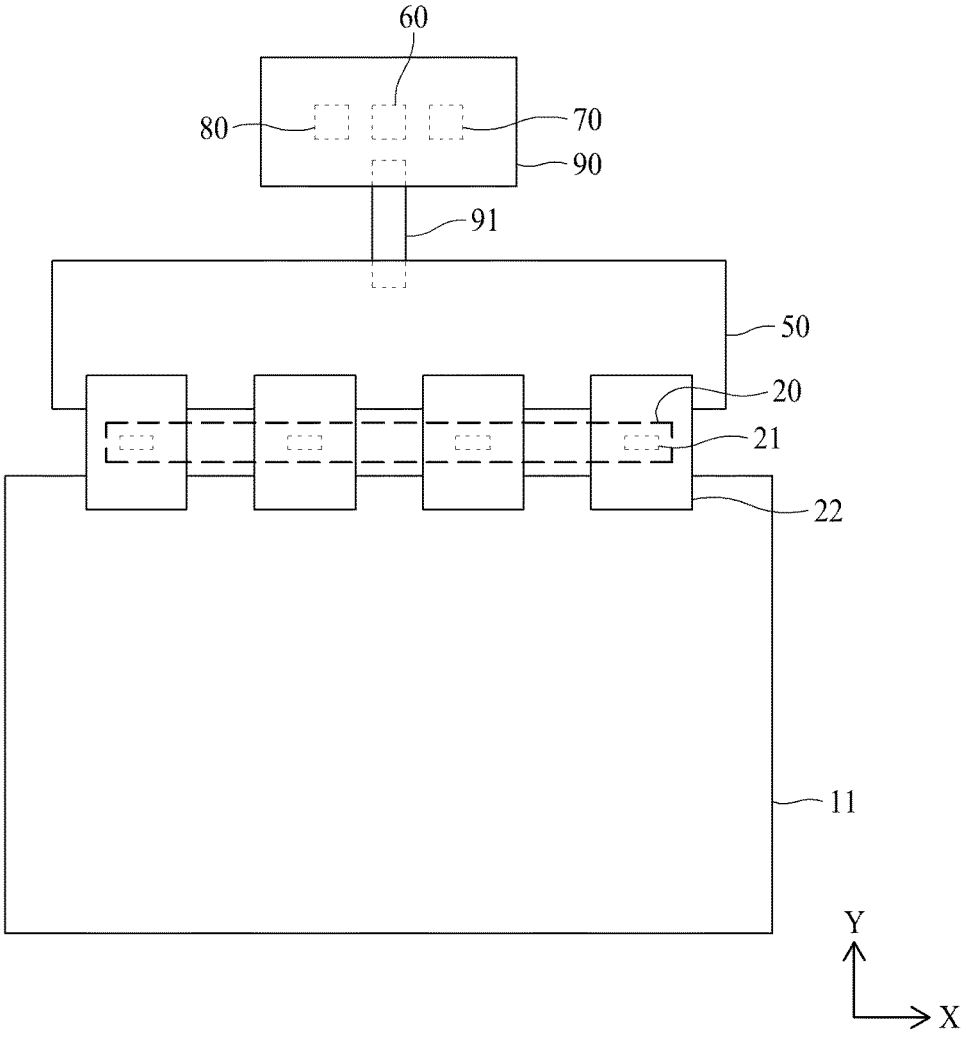
FIG. 2 is an exemplary view illustrating a lower substrate, source drive ICs, a timing controller, a digital data compensation unit, flexible circuits, a source circuit board, a flexible cable, and a control circuit board of a display panel of FIG. 1.
Figure 3:
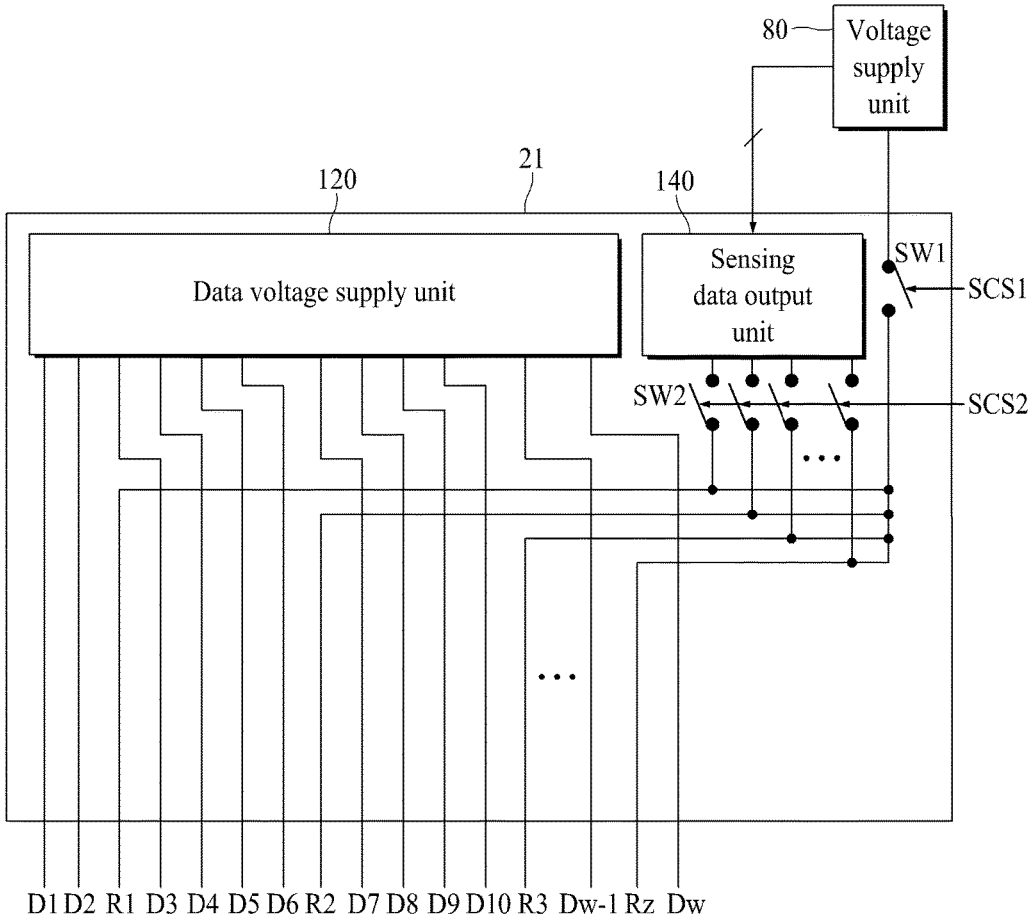
FIG. 3 is a detailed block diagram illustrating a source drive IC of FIG. 2.

FIG. 1 is a block diagram illustrating a light emitting display device according to an aspect of the present disclosure. FIG. 2 is an exemplary view illustrating a lower substrate, source drive ICs, a timing controller, a digital data compensation unit, flexible circuits, a source circuit board, a flexible cable, and a control circuit board of a display panel of FIG. 1. FIG. 3 is a detailed block diagram illustrating a source drive IC of FIG. 2.

Referring to FIGS. 1 to 3, the light emitting display device according to an aspect of the present disclosure includes a display panel 10, a data driver 20, flexible films 22, a scan driver 40, a source circuit board 50, a timing controller 60, a digital data compensation unit 70, a voltage supply unit 80, a flexible cable 91, and a control circuit board 90.

The display panel 10 includes a display area AA and a non-display area NDA provided in the periphery of the display area AA. The display area AA is an area that is provided with pixels P to display an image. On the display panel 10, data lines D1 to Dm (m is a positive integer of 2 or more), reference voltage lines R1 to Rp (p is a positive integer of 2 or more), scan lines S1 to Sn (n is a positive integer of 2 or more), and sensing signal lines SE1 to SEn are provided. The data lines D1 to Dm and the reference voltage lines R1 to Rp may be formed to cross the scan lines S1 to Sn and the sensing signal lines SE1 to SEn. The data lines D1 to Dm may be formed in parallel with the reference voltage lines R1 to Rp. The scan lines S1 to Sn may be formed in parallel with the sensing signal lines SE1 to SEn.

Figure 4:
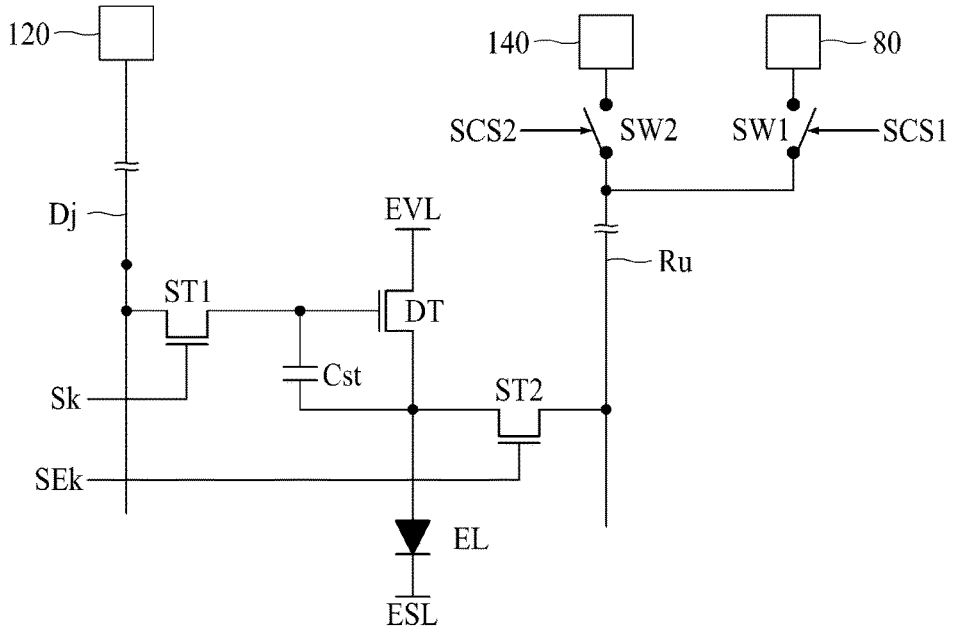
FIG. 4 is a detailed circuit diagram illustrating a pixel of FIG. 1.

Each of the pixels P may be connected to one of the data lines D1 to Dm, one of the reference voltage lines R1 to Rp, one of the scan lines S1 to Sn, and one of the sensing signal lines SE1 to SEn. Each of the pixels P of the display panel 10 may include light emitting element (EL) and a plurality of transistors for supplying a current to the light emitting element (EL) as shown in FIG. 4. Detailed description of each of the pixels P of the display area will be given with reference to FIG. 4.

The data driver 20 includes a plurality of source drive integrated circuits (IC) 21 as shown in FIG. 2. Each of the source drives IC 21 may be packaged in each of the flexible films 22. Each of the flexible films 22 may be a tape carrier package or a chip on film. Each of the flexible films 22 may be curved or bent. Each of the flexible films 22 may be attached to the lower substrate 11 and the source circuit board 80. Each of the flexible films 22 may be attached to the lower substrate 11 in a tape automated bonding (TAB) manner by using an anisotropic conductive film (ACF), whereby the source drive ICs 21 may be connected to the data lines D1 to Dm. The source circuit board 50 may be connected to the control circuit board 90 by the flexible cable 91. The source circuit board 50 may be a printed circuit board.

Each of the source drive ICs 21 may include a data voltage supply unit 120, an analog-to-digital converter (hereinafter, referred to as "ADC") 140, and a switch SW as shown in FIG. 3. In FIG. 3, for convenience of description, one source drive IC 21 is connected to w (w is a positive integer that satisfies $1 \leq w \leq m$) number of data lines D1 to Dw and z (z is a positive integer that satisfies $1 \leq z \leq p$) number of reference voltage lines R1 to Rz.

The data voltage supply unit 120 is connected to the data lines D1 to Dw and supplies the data voltages. The data voltage supply unit 120 receives compensated video data CDATA, one of first to third sensing video data PDATA1, PDATA2 and PDATA3 and a data timing control signal DCS from the timing controller 60.

The data voltage supply unit 120 converts the compensated video data CDATA to luminescence data voltages in accordance with the data timing control signal DCS in a display mode and then supplies the converted data voltages to the data lines D1 to Dw. The display mode is a mode for displaying an image by allowing the pixels P to emit light. The luminescence data voltage is to allow the light emitting element EL of the pixel P to emit light at a predetermined luminance.

The data voltage supply unit 120 converts the first sensing video data PDATA1 to a first sensing data voltage in accordance with the data timing control signal DCS in a first sensing mode and then supplies the converted data voltages to the data lines D1 to Dw. The first sensing mode is a threshold voltage compensation mode for sensing a source voltage of a driving transistor DT to compensate for a threshold voltage of a driving transistor of each of the pixels P.

The data voltage supply unit 120 converts the second sensing video data PDATA2 to a second sensing data voltage in accordance with the data timing control signal DCS in a second sensing mode and then supplies the converted data voltages to the data lines D1 to Dw. The second sensing mode is a mobility compensation mode for sensing a source voltage of a driving transistor DT to compensate for electron mobility of a driving transistor of each of the pixels P.

The data voltage supply unit 120 converts the third sensing video data PDATA3 to a third sensing data voltage in accordance with the data timing control signal DCS in a third sensing mode and then supplies the converted data voltages to the data lines D1 to Dw. The third sensing mode is a degradation compensation mode for sensing a source voltage of a driving transistor DT to compensate for degradation of a light emitting element of each of the pixels P.

The ADC 140 converts the voltages sensed from the reference voltage lines R1 to Rz to sensing data SD, which are digital data, in first to third sensing modes, and outputs the converted data to the digital data compensation unit 70.

The voltage range that can be sensed by the ADC 140 is previously determined. However, ranges of source voltages of the driving transistors DT sensed per the first to third sensing modes are different from one another. Therefore, the sensing voltage range of the ADC 140 may be set differently in the first to third sensing modes, whereby the sensing voltage range may be optimized for each of the first to third sensing modes. Detailed description of the sensing voltage range of the ADC 140 will be described later with reference to FIGS. 9, 12, 15 and 16.

A first switch SW1 connected between the reference voltage lines R1 to Rz and the voltage supply unit 80 switches the connection between the reference voltage lines R1 to Rz and the voltage supply unit 80. The first switch SW1 may be turned on or off by a first switch control signal SCS1 input from the timing controller 60. If the first switch SW1 is turned on by the first switch control signal SCS1, since the reference voltage lines R1 to Rz are connected to the voltage supply unit 80, the reference voltage of the voltage supply unit 80 may be supplied to the reference voltage lines R1 to Rz.

Second switches SW2 are connected between the reference voltage lines R1 to Rz and the ADC 140, and switches connection between the reference voltage lines R1 to Rz and the ADC 140. The second switches SW2 may be turned on or off by a second switch control signal SCS2 input from the timing controller 60. If the second switches SW2 are turned on by the second switch control signal SCS2, since the reference voltage lines R1 to Rz are connected to the ADC 140, a source voltage of each driving transistor of each of the pixels P may be sensed trough each of the reference voltage lines R1 to Rz.

The scan driver 40 includes a scan signal output unit 41 and a sensing signal output unit 42. The scan signal output unit 41 is connected to the scan lines S1 to Sn and supplies the scan signals. The scan signal output unit 41 supplies the scan signals to the scan lines S1 to Sn in accordance with the scan timing control signal SCS input from the timing controller 60.

The sensing signal output unit 42 is connected to the sensing signal lines SE1 to Sen and supplies the sensing signals. The sensing signal output unit 42 supplies sensing signals to the sensing signal lines SE1 to Sen in accordance with the sensing timing control signal SENCS input from the timing controller 60.

Each of the scan signal output unit 41 and the sensing signal output unit 42 including a plurality of transistors may directly be formed in the non-display area NDA of the display panel 10 in a gate driver in panel (GIP) manner. Alternatively, each of the scan signal output unit 41 and the sensing signal output unit 42 may be formed in the form of a driving chip and then packaged on a flexible film (not shown) connected to the display panel 10.

The timing controller 60 receives compensated video data CDATA or sensing video data PDATA and timing signals from the digital data compensation unit 70. The timing signals may include a vertical synchronization signal, a horizontal synchronization signal, a data enable signal, and a dot clock.

The timing controller 60 generates timing control signals for controlling operation timing of the data driver 20, the scan signal output unit 41 and the sensing signal output unit 42. The timing control signals include a data timing control signal DCS for controlling operation timing of the data driver 20, a scan timing control signal SCS for controlling operation timing of the scan signal output unit 41, and a sensing timing control signal SENCS for controlling operation timing of the sensing signal output unit 42.

The timing controller 60 outputs the compensated video data CDATA or the sensing video data PDATA and the data timing control signal DCS to the data driver 20. The timing controller 60 outputs the scan timing control signal SCS to the scan signal output unit 41, and outputs the sensing timing control signal SENCS to the sensing signal output unit 42. In addition, the timing controller 60 may output the switch control signal SCS for controlling the switches SW of the data driver 20.

The first sensing mode is a mode for supplying first sensing data voltages according to the first sensing video data PDATA1 to the pixels P and sensing predetermined voltages of the pixels P through the reference voltage lines R1 to Rp. The first sensing mode is a mode for sensing the source voltage of the driving transistor to compensate for the threshold voltage of the driving transistor of each of the pixels P. The source voltage of the driving transistor, which is sensed in the first sensing mode, may be converted to the first sensing data SD1 by the ADC 140 and then stored in a memory. The first sensing mode may be operated before a power source of the light emitting display device is turned off. However, the first sensing mode is not limited to this case.

The second sensing mode is a mode for supplying second sensing data voltages according to the second sensing video data PDATA2 to the pixels P and sensing predetermined voltages of the pixels P through the reference voltage lines R1 to Rp. The second sensing mode is a mode for sensing the source voltage of the driving transistor to compensate for electron mobility of the driving transistor of each of the pixels P. The source voltage of the driving transistor, which is sensed in the second sensing mode, may be converted to the second sensing data SD2 by the ADC 140 and then stored in a memory of the digital data compensation unit 70. The second sensing mode may be operated as soon as the power source of the light emitting display device is turned on, or may be operated at a predetermined period in a state that the power source of the light emitting display device is turned on.

The third sensing mode is a mode for supplying third sensing data voltages according to the third sensing video data PDATA3 to the pixels P and sensing predetermined voltages of the pixels P through the reference voltage lines R1 to Rp. The third sensing mode is a mode for sensing the source voltage of the driving transistor to compensate for degradation of the light emitting element of each of the pixels P. The source voltage of the driving transistor, which is sensed in the third sensing mode, may be converted to the third sensing data SD3 by the ADC 140 and then stored in a memory of the digital data compensation unit 70. The third sensing mode may be operated at a predetermined period in a state that the power source of the light emitting display device is turned on.

The first to third sensing video data PDATA1, PDATA2 and PDATA3 may be data different from one another or data the same as one another.

The digital data compensation unit 70 generates compensation data for compensating for the digital video data DATA by using the first to third sensing data SD1, SD2 and SD3. The digital data compensation unit 70 generates the compensated video data CDATA by externally applying the compensation data to the digital video data DATA. The digital data compensation unit 70 outputs the compensated video data CDATA to the timing controller 60.

The digital data compensation unit 70 may include a memory for storing the first to third sensing data SD1, SD2 and SD3. The memory of the digital data compensation unit 70 may be a non-volatile memory such as EEPROM (electrically erasable programmable read-only memory). The digital data compensation unit 70 may be built in the timing controller 60.

The voltage supply unit 80 generates a reference voltage and supplies the generated reference voltage to the source drive ICs 21 of the data driver 20. The voltage supply unit 80 selects any one of first to third low voltages and any one of first to third high voltages for setup of the sensing voltage range of the ADC in each of the first to third sensing modes and outputs the selected voltages to the ADC 140. The voltage supply unit 80 may generate driving voltages required for driving of the light emitting display device in addition to the reference voltage and supply the generated driving voltages to required elements, The timing controller 60, the digital data compensation unit 70 and the voltage supply unit 80 may be packaged in the control circuit board. The control circuit board 90 may be connected to the source circuit board 50 by the flexible cable 91. The control circuit board 90 may be a printed circuit board.

As described above, the light emitting display device according to the aspect of the present disclosure converts the digital video data DATA to the compensated video data CDATA by using the first to third sensing data SD1, SD2 and SD3 sensed in the sensing modes. As a result, according to the aspect of the present disclosure, the threshold voltage and electron mobility of the driving transistor of each of the pixels and degradation of the light emitting element may be compensated. The operation of the pixel P in the display mode will be described later with reference to FIGS. 5, 6A and 6B, and the operation of the pixel P in the first sensing mode will be described later with reference to FIGS. 7, 8A to 8C and 9. The operation of the pixel P in the second sensing mode will be described later with reference to FIGS. 10, 11A, 11B and 12. The operation of the pixel P in the third sensing mode will be described later with reference to FIGS. 13, 14A, 14B, 15 and 16.

FIG. 4 is a detailed circuit diagram illustrating a pixel of FIG. 1.

For convenience of description, FIG. 4 illustrates a sub pixel connected to a jth (j is a positive integer that satisfies $1 \leq j \leq m$) data line Dj, a uth (u is a positive integer that satisfies $1 \leq u \leq p$) reference voltage line Ru, a kth (k is a positive integer that satisfies $1 \leq k \leq n$) scan line Sk, and a kth sensing signal line SEk, a voltage supply unit 80, a data voltage supply unit 120, an ADC 140, and switches SW connected between the uth reference voltage line Ru and the voltage supply unit 80.

Referring to FIG. 4, the pixel P of the display panel 10 includes a light emitting element EL and a driving transistor DT, first and second switching transistors ST1 and ST2, and a storage capacitor Cst.

The light emitting element EL emits light in accordance with the current supplied through the driving transistor DT. The light emitting element EL may be an organic light emitting diode. In this case, the light emitting element EL may include an anode electrode, a hole-transporting layer, a light emitting layer, an electron-transporting layer, and the cathode electrode. If a voltage is applied to the anode electrode and the cathode electrode of the light emitting element EL, holes and electrons are moved to the light emitting layer through the hole transporting layer and the electron transporting layer, respectively, and are combined with each other in the light emitting layer, so as to emit light. The anode electrode of the light emitting element EL may be connected to a source electrode of the driving transistor DT, and the cathode electrode of the light emitting element EL may be connected to a second power voltage line VSL to which a second power lower than a first power is supplied.

The driving transistor DT controls a current flowing from a first power line EVL to the light emitting element EL, in accordance with a voltage difference between the gate electrode and the source electrode. The gate electrode of the driving transistor DT may be connected to the first electrode of the first switching transistor ST1, its source electrode may be connected to the anode electrode of the light emitting element EL, and its drain electrode may be connected to the first power line EVL.

The first switching transistor ST1 is turned on by the kth scan signal of the kth scan line Sk to connect the jth data line Dj to the gate electrode of the driving transistor DT. The gate electrode of the first transistor T1 may be connected to the kth scan line Sk, the first electrode may be connected to the gate electrode of the first driving transistor DT1, and the second electrode may be connected to the jth data line Dj.

The second switching transistor ST2 is turned on by the kth sensing signal of the kth sensing signal line SEk to connect the uth reference voltage line Ru to the source electrode of the driving transistor DT. The gate electrode of the second switching transistor ST3 may be connected to the kth sensing signal line SEk, the first electrode may be connected to the uth reference voltage line Ru, and the second electrode may be connected to the source electrode of the driving transistor DT.

The first electrode of each of the first and second switching transistors ST1 and ST2 may be, but not limited to, the source electrode and the second electrode thereof may be, but not limited to, the drain electrode. That is, the first electrode of each of the first and second switching transistors ST1 and ST2 may be the drain electrode and the second electrode thereof may be the source electrode.

The storage capacitor Cst is formed between the gate electrode and the source electrode of the driving transistor DT. The storage capacitor Cst stores a differential voltage between a gate voltage and a source voltage of the driving transistor DT.

The driving transistor DT and the first and second switching transistors ST1 and ST2 may be formed as thin film transistors. In addition, in FIG. 4, the driving transistor DT and the first and second transistors ST1 and ST2 are formed as, but not limited to, N type MOSFET (Metal Oxide Semiconductor Field Effect Transistors). The driving transistor DT and the first and second switching transistors ST1 and ST2 may be formed as P type MOSFETs. In this case, timing charts of FIGS. 5, 7, 10 and 13 may be corrected properly to conform to characteristics of the P type MOSFETs.

Figure 5:
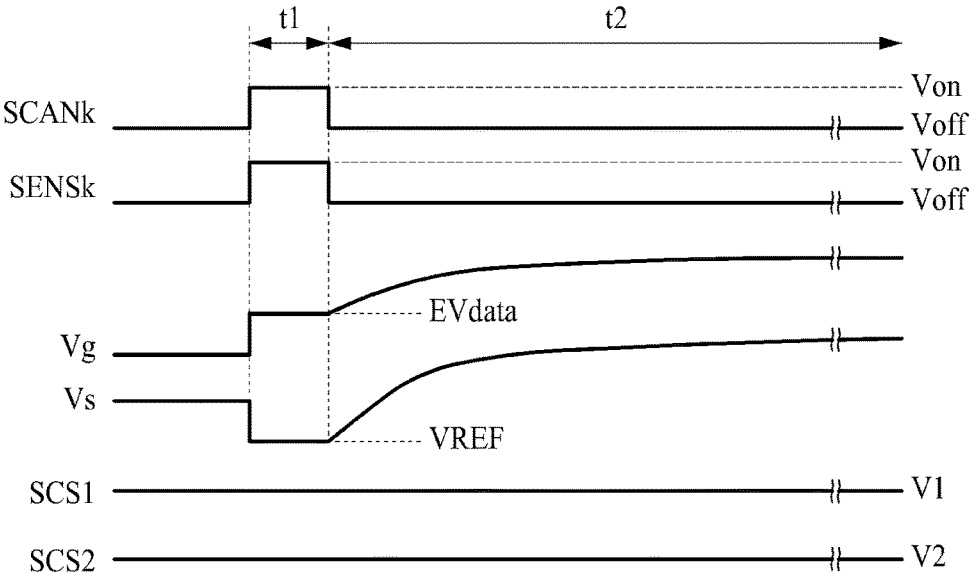
FIG. 5 is a waveform illustrating scan and sensing signals supplied to a pixel, first and second switch control signals supplied to first and second switches, and gate and source voltages of a driving transistor in a display mode.

FIG. 5 is a waveform illustrating scan and sensing signals supplied to a pixel, switch control signals supplied to switches, and gate and source voltages of a driving transistor in a display mode.

Referring to FIG. 5, in the display mode, a first frame period may include a first time period t1 and a second time period t2. The first time period t1 is a period for supplying an electroluminescence data voltage EVdata to the gate electrode of the driving transistor DT and initiating the source electrode to the reference voltage VREF. The second time period t2 is a period for allowing the light emitting element EL to emit light in accordance with the current Ids of the driving transistor DT. The first time period t1 may be one (1) horizontal period. One horizontal period indicates a period for supplying data voltages to the pixels P of one horizontal line.

The kth scan signal SCANk of the kth scan line Sk and the kth sensing signal SENSk of the kth sensing signal line SEk are supplied to gate on voltages Von for the first time period t1 and supplied to gate off voltages Voff for the second time period t2. The first and second switching transistors ST1 and ST2 of the pixel P may be turned on the gate on voltage Von, and may be turned off by the gate off voltage Voff.

The first switch control signal SCS1 may be supplied to a first logic level voltage V1 for the first and second time periods t1 and t2. The second switch control signal SCS2 may be supplied to a second logic level voltage V2 for the first and second time periods t1 and t2. Each of the first and second switches SW1 and SW2 may be turned on by the first logic level voltage, and may be turned off by the second logic level voltage.

Figure 6A:
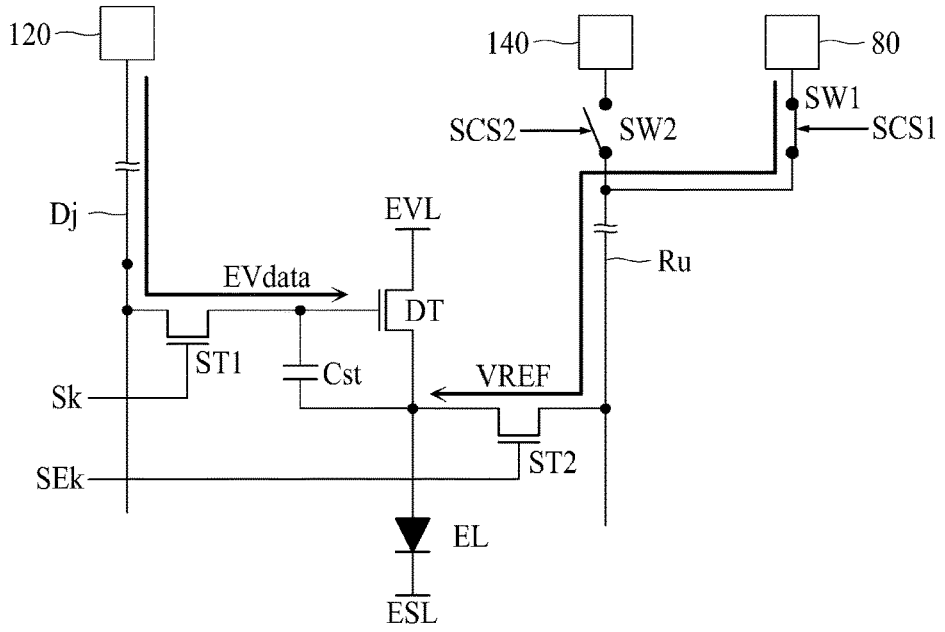
FIGS. 6A and 6B are exemplary views illustrating an operation of a pixel for first and second time periods in a display mode.
Figure 6B:
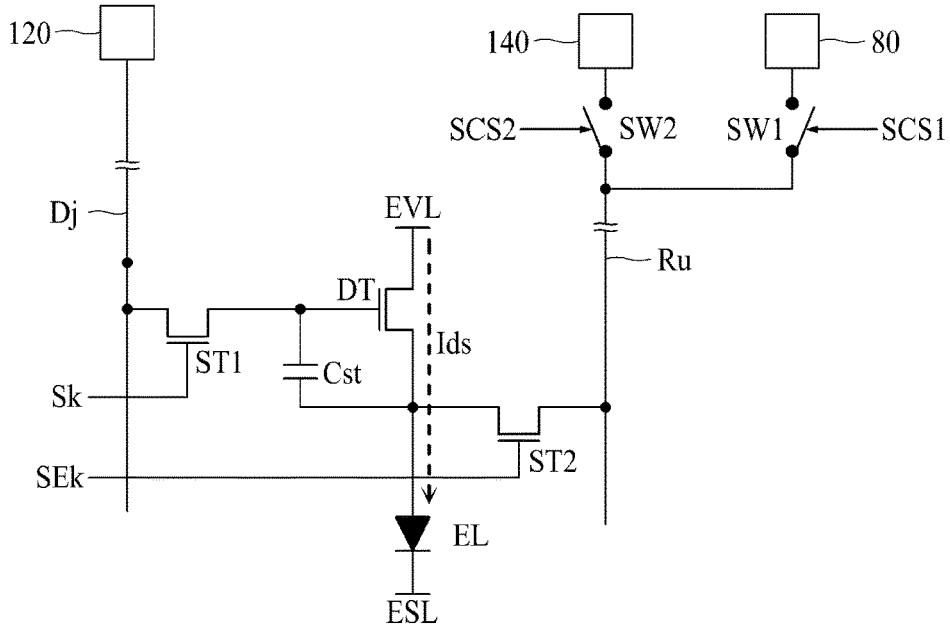

FIGS. 6A and 6B are exemplary views illustrating an operation of a pixel for first and second time periods in a display mode. The operation of the pixel P in the display mode will be described in detail with reference to FIGS. 6A, 6B and 7.

The first switch SW1 is turned on by the first switch control signal SCS1 of the first logic level voltage V1 for the first and second time periods t1 and t2 of the display mode, and the second switch SW2 is turned off by the second switch control signal SCS2 of the second logic level voltage V2. For this reason, in the display mode, the reference voltage VREF is supplied from the voltage supply unit 80 to the uth reference voltage line Ru.

Firstly, as shown in FIG. 6A, the first switching transistor ST1 is turned on by the kth scan signal SCANk of the gate on voltage Von supplied to the kth scan line Sk for the first time period t1. The second switching transistor ST2 is turned on by the kth sensing signal SENSk of the gate on voltage Von supplied to the kth sensing signal line SEk for the first time period t1. An electroluminescence data voltage EVdata of the jth data line Dj is supplied to the gate electrode of the driving transistor DT due to turn-on of the first switching transistor ST1 for the first time period t1. The reference voltage VREF of the uth reference voltage line RU is supplied to the source electrode of the driving transistor DT due to turn-on of the second switching transistor ST2 for the first time period t1.

Secondly, as shown in FIG. 6B, the first switching transistor ST1 is turned off by the kth scan signal SCANk of the gate off voltage Voff supplied to the kth scan line Sk for the second time period t2. The second switching transistor ST2 is turned off by the kth sensing signal SENSk of the gate off voltage Voff supplied to the kth sensing signal line SEk for the second time period t2.

The current Ids according to the voltage difference between the gate voltage Vg and the source voltage Vs of the driving transistor DT flows to the light emitting element EL for the second time period t2. For this reason, the light emitting element EL emits light. Hereinafter, for convenience of description, "the current Ids flowing through the driving transistor DT in accordance with the voltage difference between the gate voltage Vg and the source voltage Vs of the driving transistor DT" will be defined as "the current Ids of the driving transistor DT.

As described above, in the aspect of the present disclosure, the electroluminescence data voltage EVdata is supplied to the pixel P in the display mode. The electroluminescence data voltage EVdata is a data voltage generated in accordance with compensated video data CDATA compensated from the digital video data DATA after the source voltage of the driving transistor DT is sensed in the sensing mode. As a result, in the aspect of the present disclosure, the light emitting element EL of the pixel P may emit light in accordance with the current Ids of the driving transistor DT, which does not depend on the threshold voltage of the driving transistor DT. Therefore, in the aspect of the present disclosure, luminance uniformity of the pixels P may be enhanced.

Figure 7:
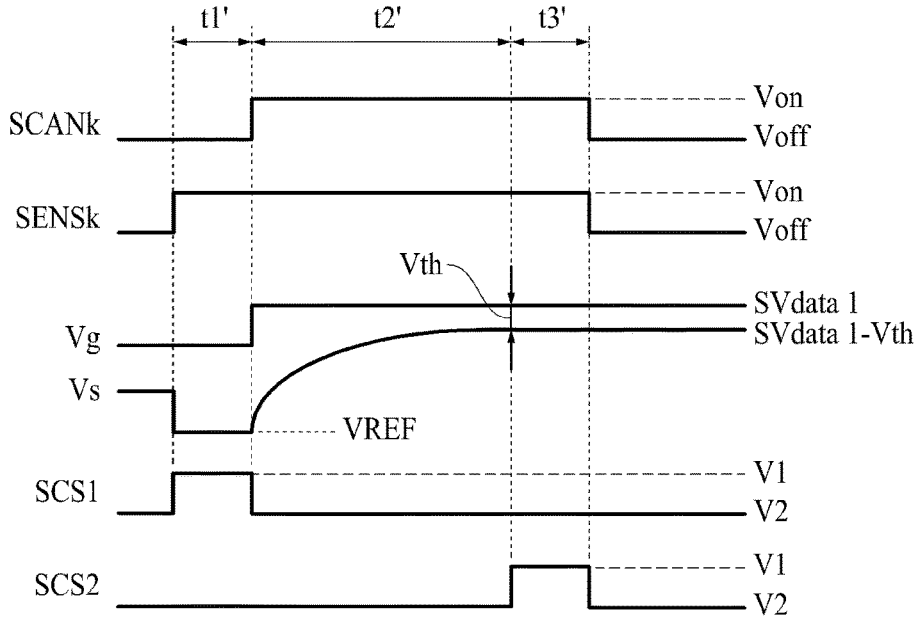
FIG. 7 is a waveform illustrating scan and sensing signals supplied to a pixel, first and second switch control signals supplied to first and second switches, and gate and source voltages of a driving transistor in a first sensing mode.

FIG. 7 is a waveform illustrating scan and sensing signals supplied to a pixel, first and second switch control signals supplied to first and second switches, and gate and source voltages of a driving transistor in a first sensing mode.

Referring to FIG. 7, in the first sensing mode, the first frame period may include first to third time periods t1' to t3'. The first time period t1' is a period for initiating the source electrode of the driving transistor DT to the reference voltage VREF. The second time period t2' is a period for supplying the first sensing data voltage SVdata1 to the gate electrode of the driving transistor DT. The third time period t3' is a period for sensing the source voltage of the driving transistor DT.

The kth scan signal SCANk of the kth scan line SK is supplied to the gate on voltage Von for the second and third time periods t2' and t3'. In FIG. 7, the kth scan signal SCANk of the kth scan line Sk is supplied to the gate off voltage Voff for the first time period t1'. However, the kth scan signal SCANk of the kth scan line Sk may be supplied to the gate on voltage. The kth sensing signal SENk of the kth sensing signal line SEk is supplied to the gate on voltage Von for the first to third time periods t1' to t3'. The first and second switching transistors ST1 and ST2 of the pixel P may be turned on by the gate on voltage Von and may be turned off by the gate off voltage Voff.

The first switch control signal SCS1 is supplied to a first logic level voltage V1 for the first time period t1' and supplied to a second logic level voltage V2 for the second and third time periods t2' and t3'. The second switch control signal SCS2 is supplied to a second logic level voltage V2 for the first and second time periods t1' and t2' and supplied to a first logic level voltage V1 for the third time period t3'. Each of the first and second switches SW1 and SW2 may be turned on by the first logic level voltage and may be turned off by the second logic level voltage.

Figure 8A:
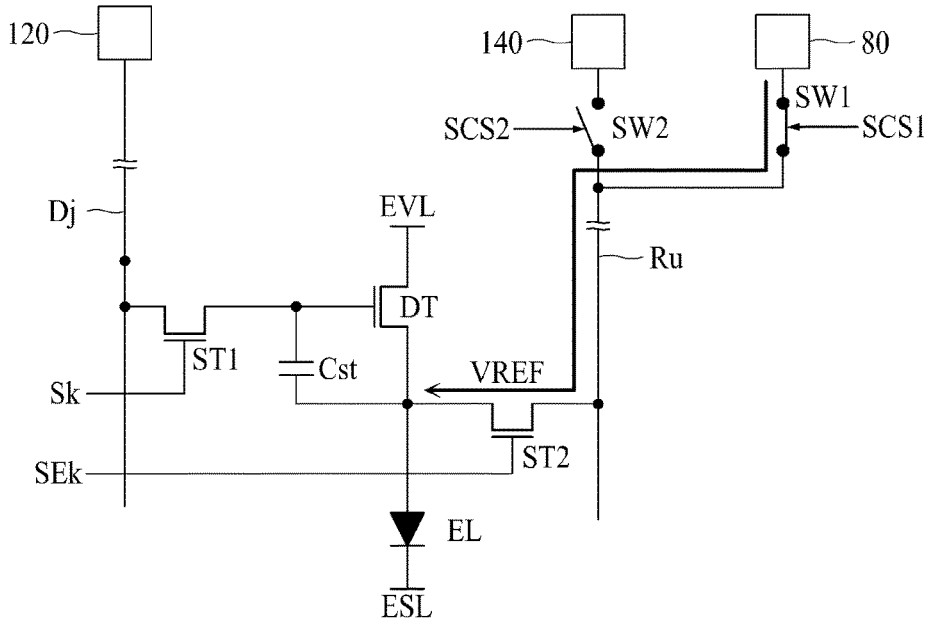
FIGS. 8A to 8C are exemplary views illustrating an operation of a pixel for first to third time periods in a first sensing mode.
Figure 8B:
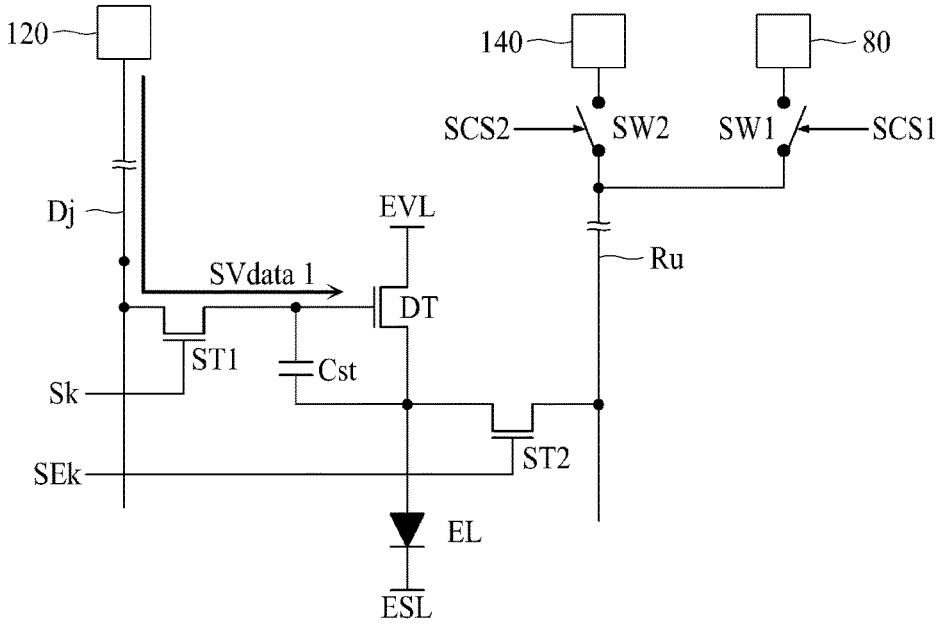
Figure 8C:
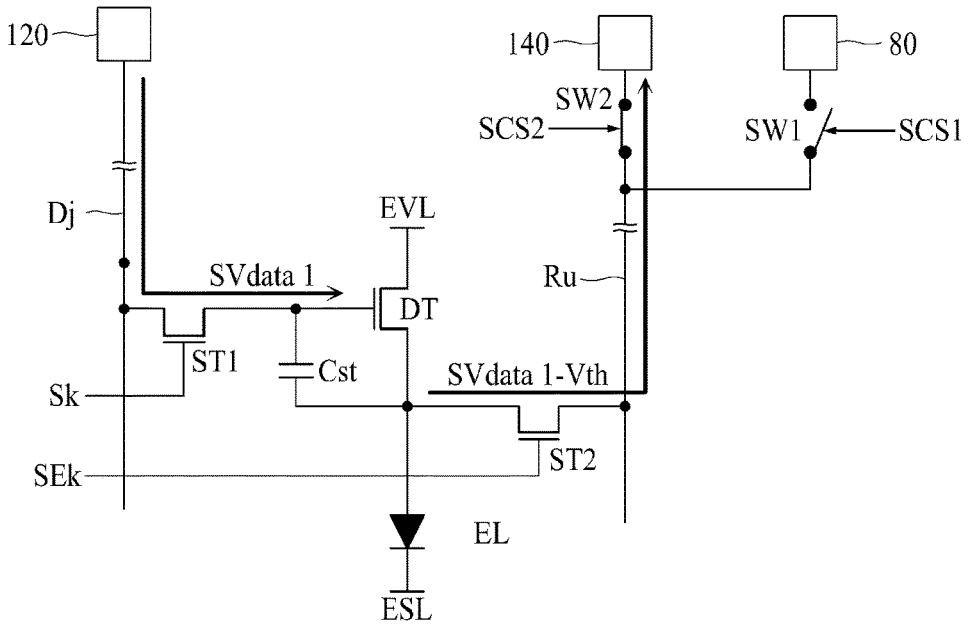

FIGS. 8A to 8C are exemplary views illustrating an operation of a pixel for first to third time periods in a first sensing mode. Hereinafter, the operation of the pixel P in the first sensing mode will be described in detail with reference to FIGS. 7 and 8A to 8C.

Firstly, as shown in FIG. 8A, the first switching transistor ST1 is turned on by the kth scan signal SCANk of the gate off voltage Voff supplied to the kth scan line Sk for the first time period t1'. The second switching transistor ST2 is turned on by the kth sensing signal SENSk of the gate on voltage Von supplied to the kth sensing signal line SEk for the first time period t1'. The first switch SW1 is turned on by the first switch control signal SCS1 of the first logic level voltage V1 for the first time period t1', and the second switch SW2 is turned off by the second switch control signal SCS2 of the second logic level voltage V2 for the first time period t1'.

The reference voltage VREF is supplied from the voltage supply unit 80 to the uth reference voltage line Ru due to turn-on of the first switch SW1 for the first time period t1'. The reference voltage VREF of the uth reference voltage line Ru is supplied to the source electrode of the driving transistor DT due to turn-on of the second switching transistor ST2 for the first time period t1'. That is, the source electrode of the driving transistor DT is initialized to the reference voltage VREF.

Secondly, as shown in FIG. 8B, the first switching transistor ST1 is turned off by the kth scan signal SCANk of the gate on voltage Von supplied to the kth scan line Sk for the second time period t2'. The second switching transistor ST2 is turned on by the kth sensing signal SENSk of the gate on voltage Von supplied to the kth sensing signal line SEk for the second time period t2'. The first switch SW1 is turned off by the second switch control signal SCS2 of the second logic level voltage V2 for the second time period t2', and the second switch SW2 is turned off by the second switch control signal SCS2 of the second logic level voltage V2 for the second time period t2'.

The reference voltage VREF is not supplied to the uth reference voltage line Ru due to turn-off of the first switch SW1 for the second time period t2'. Also, since the first switching transistor ST1 is turned on for the second time period t2', the first sensing data voltage SVdata1 is supplied to the gate electrode of the driving transistor DT.

The voltage difference (Vgs=SVdata1−VREF) between the gate electrode and the source electrode of the driving transistor DT is greater than the threshold voltage Vth of the driving transistor DT for the second time period t2'. Thus, the driving transistor DT flows a current until the voltage difference between the gate electrode and the source electrode reaches the threshold voltage Vth. For this reason, the source voltage of the driving transistor DT ascends to "SVdata1−Vth" as shown in FIG. 7. That is, the threshold voltage of the driving transistor DT is sensed by the source electrode of the driving transistor DT for the second time period t2'.

Thirdly, as shown in FIG. 8C, the first switching transistor ST1 is turned on by the kth scan signal SCANk of the gate on voltage Von supplied to the kth scan line Sk for the third time period t3'. The second switching transistor ST2 is turned on by the kth sensing signal SENSk of the gate on voltage Von supplied to the kth sensing signal line SEk for the third time period t3'. The first switch SW1 is turned off by the second switch control signal SCS2 of the second logic level voltage V2 for the third time period t3', and the second switch SW2 is turned on by the second switch control signal SCS2 of the first logic level voltage V1 for the third time period t3'.

The uth reference voltage line Ru is connected to the ADC 140 due to turn-on of the second switch SW2 for the third time period t3'. The source electrode of the driving transistor DT is connected to the ADC through the uth reference voltage line Ru due to turn-on of the second switching transistor ST2 for the third time period t3'. Therefore, the ADC 140 may sense the source voltage of the driving transistor DT, that is, "SVdata1−Vth".

As described above, in the aspect of the present disclosure, the source voltage "SVdata1−Vth" of the driving transistor DT, in which the threshold voltage of the driving transistor DT is reflected, may be sensed in the first sensing mode.

Figure 9:
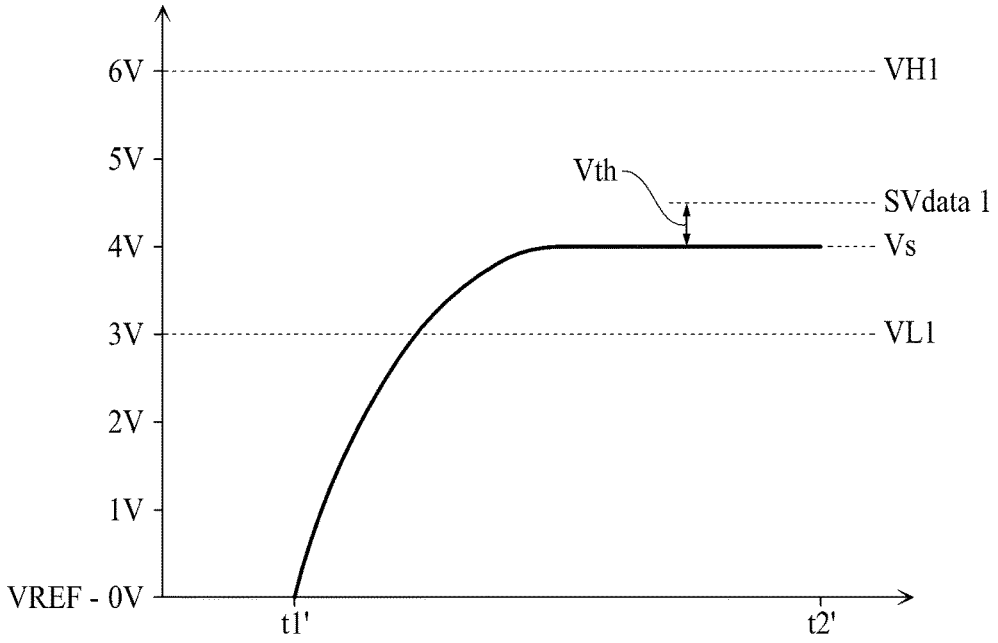
FIG. 9 is a graph illustrating an example of a sensing voltage range of an analog-to-digital converter in a first sensing mode.

Meanwhile, the first sensing mode is a mode for sensing the source voltage of the driving transistor DT, which has ascended to "SVdata1−Vth" as shown in FIG. 7, by flowing a current until the voltage difference Vgs between the gate electrode and the source electrode of the driving transistor DT reaches the threshold voltage Vth in a state that the first sensing data voltage SVdata1 is applied to the gate electrode of the driving transistor DT. Therefore, as shown in FIG. 9, the source voltage Vs of the driving transistor DT, which is sensed in the first sensing mode, ascends to reach a voltage level near the first sensing data voltage SVdata1. Therefore, the sensing voltage range of the ADC 140 may be set between a first low voltage VL1 higher than the reference voltage VREF and a first high voltage VH1 in the first sensing mode. The ADC 140 may receive the first low voltage VL1 and the first high voltage VH1 from the voltage supply unit 80 to set the sensing voltage range in the first sensing mode. In FIG. 9, the first low voltage VL1 is, but not limited to, 3V and the first high voltage VH1 is, but not limited to, 6V.

Figure 10:
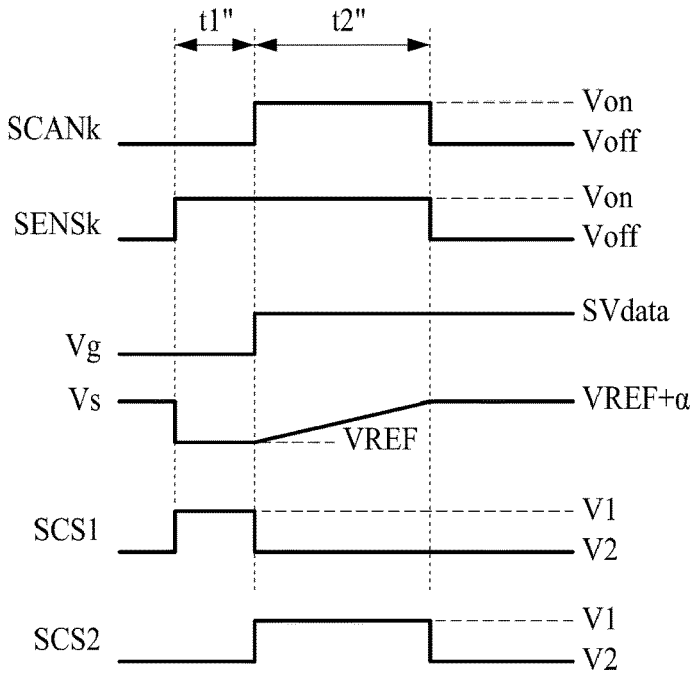
FIG. 10 is a waveform illustrating scan and sensing signals supplied to a pixel, first and second switch control signals supplied to first and second switches, and gate and source voltages of a driving transistor in a second sensing mode.

FIG. 10 is a waveform illustrating scan and sensing signals supplied to a pixel, first and second switch control signals supplied to first and second switches, and gate and source voltages of a driving transistor in a second sensing mode.

Referring to FIG. 10, in the second sensing mode, the first frame period may include first and second time periods t1" and t2". The first time period t1" is a period for initiating the source electrode of the driving transistor DT to the reference voltage VREF. The second time period t2" is a period for applying the second sensing data voltage SVdata2 to the gate electrode of the driving transistor DT and sensing the source voltage of the driving transistor DT.

The kth scan signal SCANk of the kth scan line SK is supplied to the gate on voltage Von for the second time period t2". In FIG. 10, the kth scan signal SCANk of the kth scan line Sk is supplied to the gate off voltage Voff for the first time period t1". However, the kth scan signal SCANk of the kth scan line Sk may be supplied to the gate on voltage. The kth sensing signal SENk of the kth sensing signal line SEk is supplied to the gate on voltage Von for the first and second time periods t1" and t2". The first and second switching transistors ST1 and ST2 of the pixel P may be turned on by the gate on voltage Von and may be turned off by the gate off voltage Voff.

The first switch control signal SCS1 is supplied to a first logic level voltage V1 for the first time period t1" and supplied to a second logic level voltage V2 for the second time period t2". The second switch control signal SCS2 is supplied to a second logic level voltage V2 for the first time period t1" and supplied to a first logic level voltage V1 for the second time period t2". Each of the first and second switches SW1 and SW2 may be turned on by the first logic level voltage and may be turned off by the second logic level voltage.

Figure 11A:
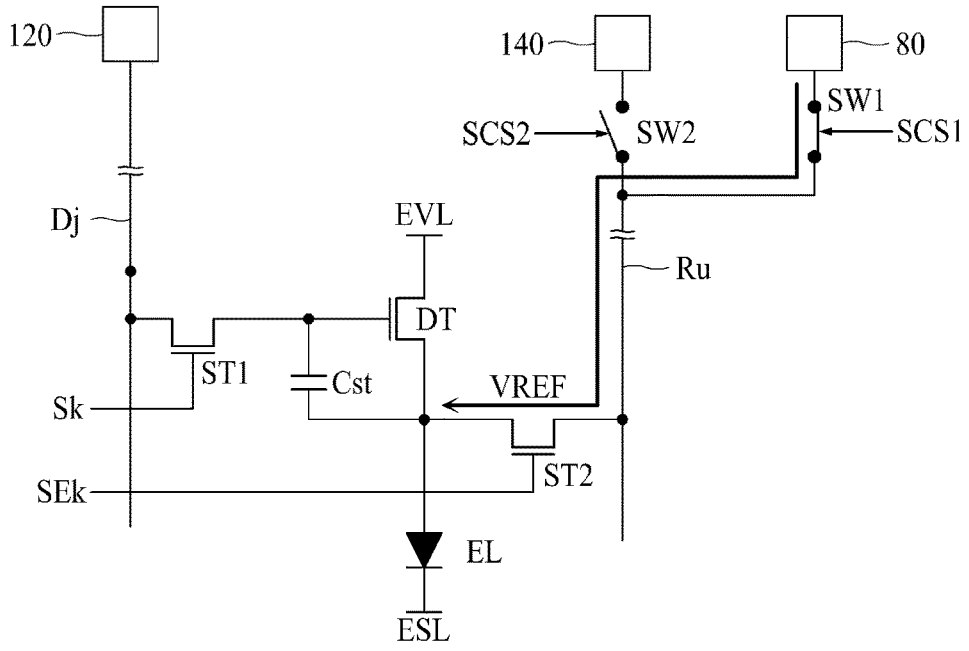
FIGS. 11A and 11B are exemplary views illustrating an operation of a pixel for first and second time periods in a second sensing mode.
Figure 11B:
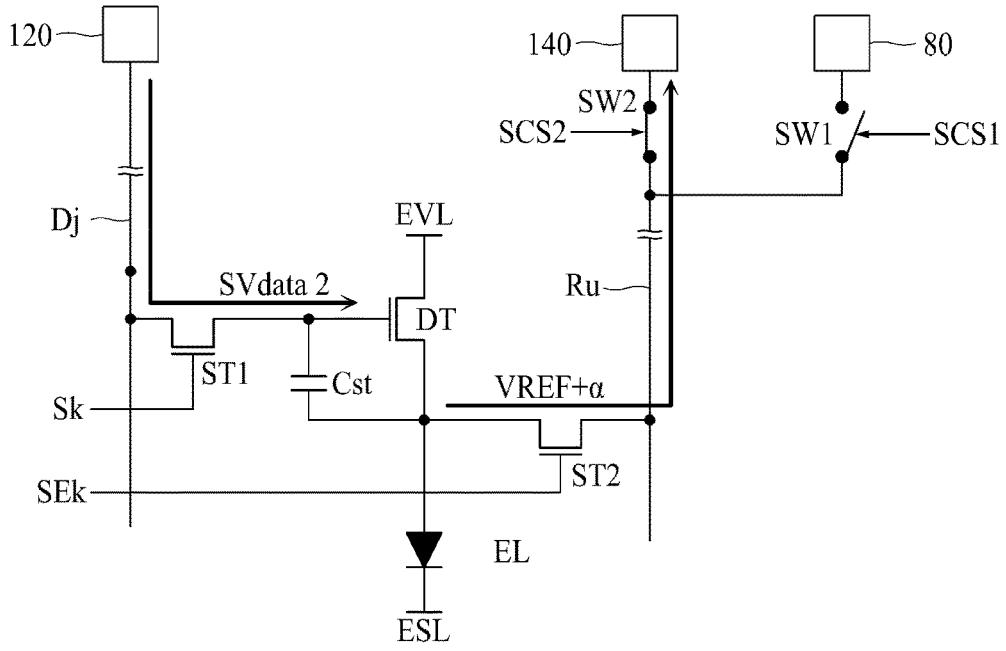

FIGS. 11A and 11B are exemplary views illustrating an operation of a pixel for first and second time periods in a second sensing mode. Hereinafter, the operation of the pixel P in the second sensing mode will be described in detail with reference to FIGS. 10 and 11A and 11B.

Firstly, as shown in FIG. 11A, the first switching transistor ST1 is turned on by the kth scan signal SCANk of the gate off voltage Voff supplied to the kth scan line Sk for the first time period t1". The second switching transistor ST2 is turned on by the kth sensing signal SENSk of the gate on voltage Von supplied to the kth sensing signal line SEk for the first time period t1". The first switch SW1 is turned on by the first switch control signal SCS1 of the first logic level voltage V1 for the first time period t1", and the second switch SW2 is turned off by the second switch control signal SCS2 of the second logic level voltage V2 for the first time period t1".

The reference voltage VREF is supplied from the voltage supply unit 80 to the uth reference voltage line Ru due to turn-on of the first switch SW1 for the first time period t1". The reference voltage VREF of the uth reference voltage line Ru is supplied to the source electrode of the driving transistor DT due to turn-on of the second switching transistor ST2 for the first time period t1". That is, the source electrode of the driving transistor DT is initialized to the reference voltage VREF.

Secondly, as shown in FIG. 11B, the first switching transistor ST1 is turned off by the kth scan signal SCANk of the gate on voltage Von supplied to the kth scan line Sk for the second time period t2". The second switching transistor ST2 is turned on by the kth sensing signal SENSk of the gate on voltage Von supplied to the kth sensing signal line SEk for the second time period t2". The first switch SW1 is turned off by the first switch control signal SCS1 of the second logic level voltage V2 for the second time period t2", and the second switch SW2 is turned on by the second switch control signal SCS2 of the first logic level voltage V1 for the second time period t2".

The reference voltage VREF is not supplied to the uth reference voltage line Ru due to turn-off of the first switch SW1 for the second time period t2". Also, the reference voltage line Ru is connected to the ADC 140 due to turn-on of the second switch SW2 for the second time period t2". The second sensing data voltage SVdata2 is supplied to the gate electrode of the driving transistor DT due to turn-on of the first switching transistor ST1 for the second time period t2". The source electrode of the driving transistor DT is connected to the ADC 140 through the uth reference voltage line Ru due to turn-on of the second switching transistor ST2 for the second time period t2".

Since the voltage difference (Vgs=SVdata2−VREF) between the gate electrode and the source electrode of the driving transistor DT is greater than the threshold voltage Vth of the driving transistor DT for the second time period t2", the driving transistor DT flows a current. The second time period t2" of FIG. 10 is shorter than the second time period t2' of FIG. 7.

At this time, the current of the driving transistor DT may be defined as expressed by the following Equation 1.

$$Ids = \frac{K \times Cox \times W/L}{2} \times (Vgs - Vth)^2 \quad \text{[Equation 1]}$$

In the Equation 1, "Ids" means a current of the driving transistor DT, "K" means electron mobility, "Cox" means capacitance of an insulating film, "W" means a channel width of the driving transistor DT, and "L" means a channel length of the driving transistor DT.

Since the current of the driving transistor DT is proportional to the electron mobility K of the driving transistor DT as expressed by the Equation 1, an ascending amount of the source voltage Vs of the driving transistor DT for the second time period t2" is proportional to the electron mobility K of the driving transistor DT. That is, if the electron mobility of the driving transistor DT becomes great, the ascending amount of the source voltage Vs of the driving transistor DT becomes greater for the second time period t2".

As a result, the ascending amount of the source voltage Vs of the driving transistor DT is varied depending on the electron mobility K of the driving transistor DT for the second time period t2". In FIG. 9, the ascending amount of the source voltage Vs according to the electron mobility K is defined as a. The source voltage of the driving transistor DT ascends to reach "VREF+α" as shown in FIG. 9 in accordance with the electron mobility K. Therefore, the voltage in which the electron mobility K of the driving transistor DT is reflected in the source electrode of the driving transistor DT is sensed for the second time period t2".

As described above, in the aspect of the present disclosure, the source voltage "VREF+α" of the driving transistor, in which the electron mobility K of the driving transistor DT is reflected, may be sensed in the second sensing mode.

Figure 12:
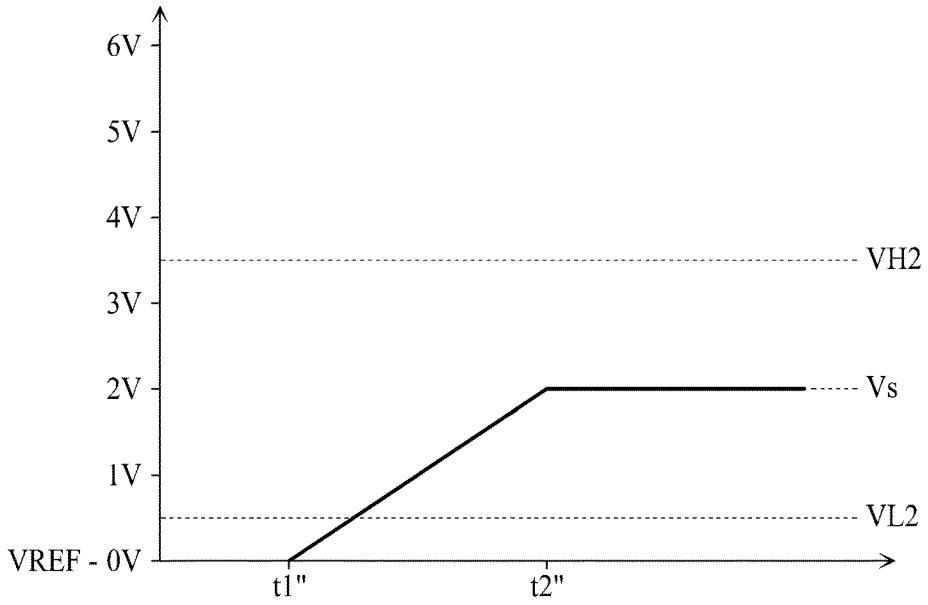
FIG. 12 is a graph illustrating an example of a sensing voltage range of an analog-to-digital converter in a second sensing mode.

Meanwhile, the second sensing mode is a mode for sensing the ascending amount of the source voltage Vs of the driving transistor for a predetermined short time period in a state that the second sensing data voltage SVdata2 is applied to the gate electrode of the driving transistor DT. Therefore, as shown in FIG. 12, the source voltage Vs of the driving transistor DT, which is sensed in the second sensing mode, has a level higher than the reference voltage VREF. However, the ascending amount of the source voltage Vs of the driving transistor DT in the second sensing mode is smaller than the ascending amount of the source voltage Vs of the driving transistor DT in the first sensing mode. Therefore, the sensing voltage range of the ADC 140 may be set between the second low voltage VL2 higher than the reference voltage VREF and lower than the first low voltage VL1 and the second high voltage VH2 lower than the first high voltage VH1. The ADC 140 may receive the second low voltage VL2 and the second high voltage VH2 from the voltage supply unit 80 to set the sensing voltage range in the second sensing mode. In FIG. 12, the second low voltage VL2 is, but not limited to, 0.5V and the second high voltage VH2 is, but not limited to, 3.5V.

Figure 13:
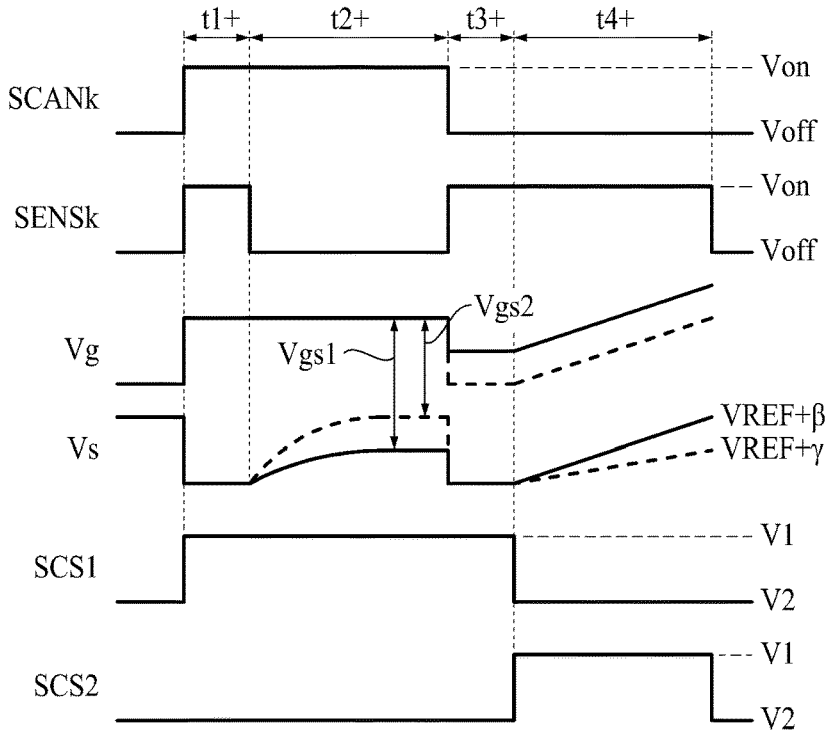
FIG. 13 is a waveform illustrating scan and sensing signals supplied to a pixel, switch control signals supplied to switches, and gate and source voltages of a driving transistor in a third sensing mode.

FIG. 13 is a waveform illustrating scan and sensing signals supplied to a pixel, switch control signals supplied to switches, and gate and source voltages of a driving transistor in a third sensing mode.

Referring to FIG. 13, in the third sensing mode, the first frame period may include first to fourth time periods t1+, t2+, t3+ and t4+. The first time period t1+ is a period for supplying the third sensing data voltage SVdata3 to the gate electrode of the driving transistor DT and initiating the source electrode of the driving transistor DT to the reference voltage VREF. The second time period t2+ is a degradation recognition period for storing a voltage between gate and source electrodes of the driving transistor DT in accordance with a degradation level of the light emitting element EL, and the third time period t3+ is a period for initializing the source electrode of the driving transistor DT to the reference voltage VREF. The fourth time period t4+ is a period for sensing the source voltage Vs of the driving transistor DT in accordance with the voltage between the gate and source electrodes of the driving transistor DT.

The kth scan signal SCANk of the kth scan line SK is supplied to the gate on voltage Von for the second time period t2+, and supplied to the gate off voltage Voff for the third and fourth time periods t3+ and t4+. In FIG. 13, the kth scan signal SCANk of the kth scan line Sk is supplied to the gate on voltage Von for the first time period t1+. However, the kth scan signal SCANk of the kth scan line Sk may be supplied to the gate off voltage. The kth sensing signal SENk of the kth sensing signal line SEk is supplied to the gate on voltage Von for the first, third and fourth time periods t1+, t3+ and t4+ and supplied to the gate off voltage Voff for the second time period t2+. The first and second switching transistors ST1 and ST2 of the pixel P may be turned on by the gate on voltage Von and may be turned off by the gate off voltage Voff.

The first switch control signal SCS1 is supplied to the first logic level voltage V1 for the first and third time periods t1+ and t3+ and supplied to the second logic level voltage V2 for the fourth time period t4+. In FIG. 13, the first switch control signal SCS1 is supplied to the first logic level voltage V1 for the second time period t2+. However, the first switch control signal SCS1 may be supplied to the second logic level voltage V2. The second switch control signal SCS2 is supplied to the second logic level voltage V2 for the first to third time periods t1+, t2+ and t3+ and supplied to the first logic level voltage V1 for the fourth time period t4+. Each of the first and second switches SW1 and SW2 may be turned on by the first logic level voltage and may be turned off by the second logic level voltage.

FIGS. 14*a* to 14D are exemplary views illustrating an operation of a pixel for first to fourth time periods in a third sensing mode.

Figure 14A:
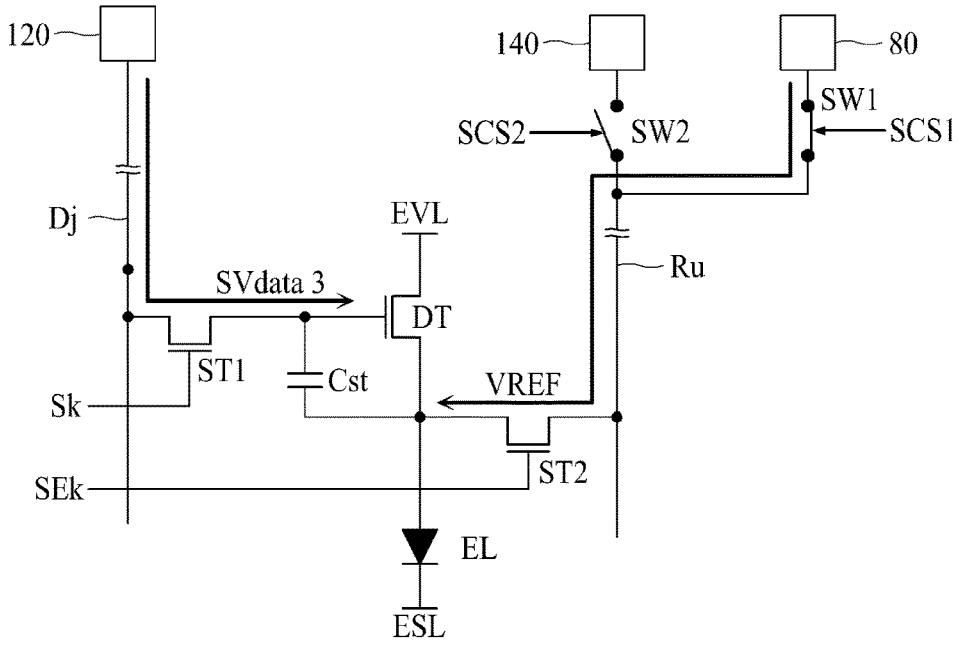
FIGS. 14A to 14D are exemplary views illustrating an operation of a pixel for first to fourth time periods in a third sensing mode.

Firstly, as shown in FIG. 14A, the first switching transistor ST1 is turned on by the kth scan signal SCANk of the gate on voltage Von supplied to the kth scan line Sk for the first time period t1+. The second switching transistor ST2 is turned on by the kth sensing signal SENSk of the gate on voltage Von supplied to the kth sensing signal line SEk for the first time period t1+. The first switch SW1 is turned on by the first switch control signal SCS1 of the first logic level voltage V1 for the first time period t1+, and the second switch SW2 is turned off by the second switch control signal SCS2 of the second logic level voltage V2 for the first time period t1+.

The third sensing data voltage SVdata3 is supplied to the gate electrode of the driving transistor DT due to turn-on of the first switching transistor ST1 for the first time period t1+. In addition, the reference voltage VREF is supplied from the voltage supply unit 80 to the uth reference voltage line Ru due to turn-on of the first switch SW1 for the first time period t1+. The reference voltage VREF of the uth reference voltage line Ru is supplied to the source electrode of the driving transistor DT due to turn-on of the second switching transistor ST2 for the first time period t1+. That is, the source electrode of the driving transistor DT is initialized to the reference voltage VREF.

Figure 14B:
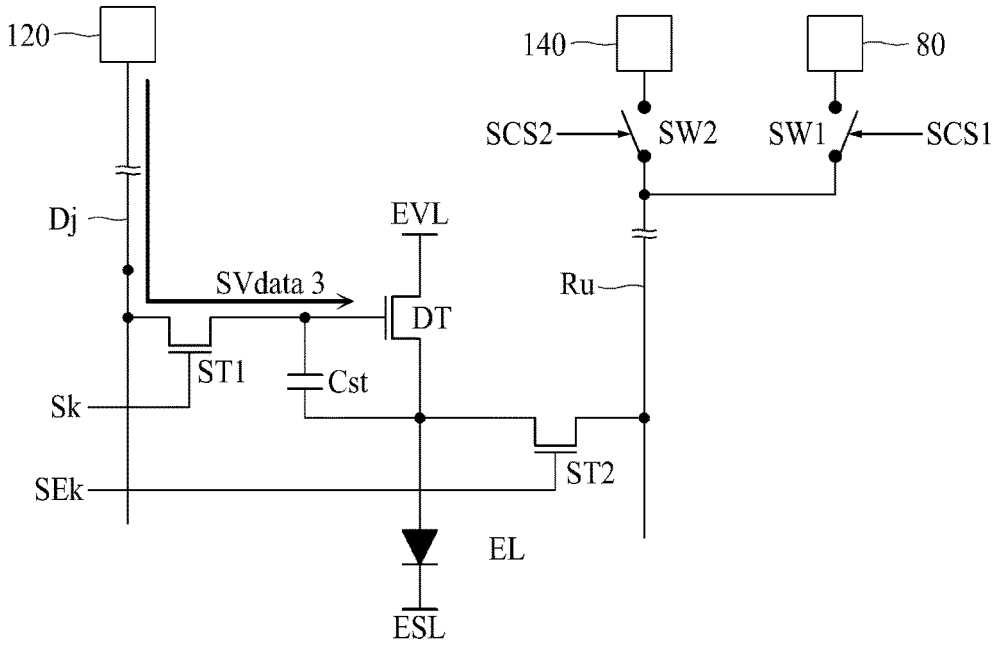

Secondly, as shown in FIG. 14B, the first switching transistor ST1 is turned on by the kth scan signal SCANk of the gate on voltage Von supplied to the kth scan line Sk for the second time period t2+. The second switching transistor ST2 is turned off by the kth sensing signal SENSk of the gate off voltage Voff supplied to the kth sensing signal line SEk for the second time period t2+.

The third sensing data voltage SVdata3 is supplied to the gate electrode of the driving transistor DT due to turn-on of the first switching transistor ST1 for the second time period t2+. In addition, the reference voltage VREF is not supplied to the source electrode of the driving transistor DT due to turn-off of the second switch SW2 for the second time period t2+.

Since the voltage difference (Vgs=SVdata3−VREF) between the gate electrode and the source electrode of the driving transistor DT is greater than the threshold voltage Vth of the driving transistor DT for the second time period t2+, the driving transistor DT flows a current.

Meanwhile, if the light emitting element EL is driven for a long time, the light emitting element EL may be degraded. For this reason, emission luminance of the light emitting element EL may be reduced. If the light emitting element EL is degraded, a driving voltage of the light emitting element EL ascends. For this reason, even though the same data voltage is applied to the gate electrode of the driving transistor DT as shown in FIG. 13, if the light emitting element EL is degraded, the source voltage of the driving transistor DT becomes higher than before the light emitting element EL is degraded. As a result, the voltage Vgs2 between the gate and source electrodes of the driving transistor DT when the light emitting element EL is degraded becomes smaller than the voltage Vgs1 between the gate and source electrodes of the driving transistor DT before the light emitting element EL is degraded. In FIG. 13, the gate voltage Vg and the source voltage Vs of the driving transistor DT before the light emitting element EL is degraded are shown as solid lines, and the gate voltage Vg and the source voltage Vs of the driving transistor DT after the light emitting element EL is degraded are shown as dotted lines.

Figure 14C:
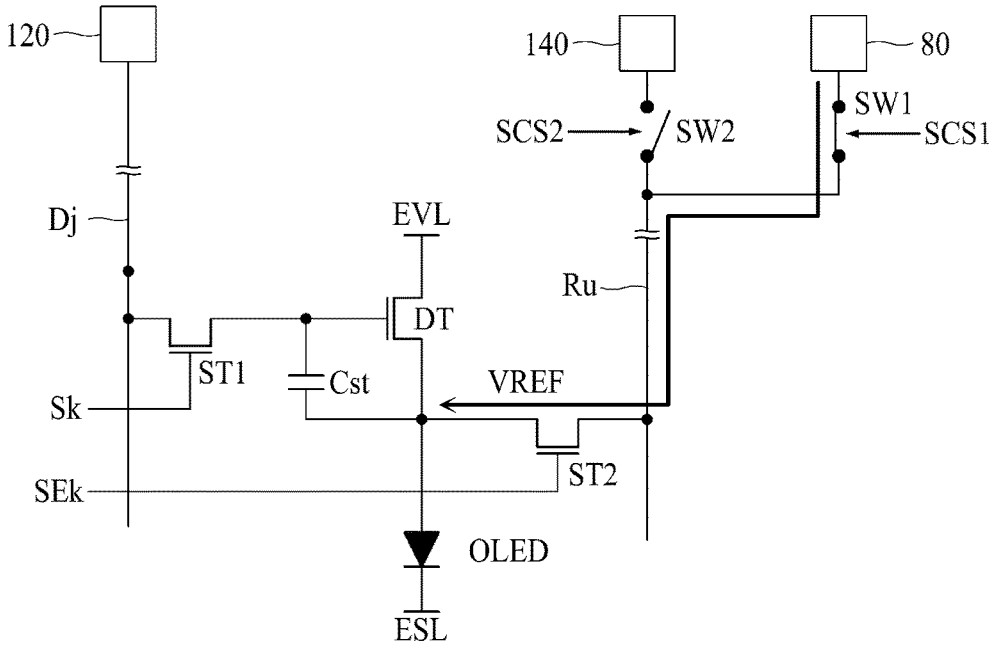

Thirdly, as shown in FIG. 14C, the first switching transistor ST1 is turned off by the kth scan signal SCANk of the gate off voltage Voff supplied to the kth scan line Sk for the third time period t3+. The second switching transistor ST2 is turned on by the kth sensing signal SENSk of the gate on voltage Von supplied to the kth sensing signal line SEk for the third time period t3+. The first switch SW1 is turned on by the first switch control signal SCS1 of the first logic level voltage V1 for the third time period t3+, and the second switch SW2 is turned off by the second switch control signal SCS2 of the second logic level voltage V2 for the third time period t3+.

The reference voltage VREF is supplied from the voltage supply unit 80 to the uth reference voltage line Ru due to turn-on of the first switch SW1 for the third time period t3+. The reference voltage VREF of the uth reference voltage line Ru is supplied to the source electrode of the driving transistor DT due to turn-on of the second switching transistor ST2 for the third time period t3+. That is, the source electrode of the driving transistor DT is initialized to the reference voltage VREF. Also, the voltage Vgs between the gate and source electrodes of the driving transistor DT is maintained by the storage capacitor Cst, the gate voltage Vg of the driving transistor DT may be lowered as much as the variable amount of the source voltage Vs of the driving transistor DT as shown in FIG. 13.

Figure 14D:
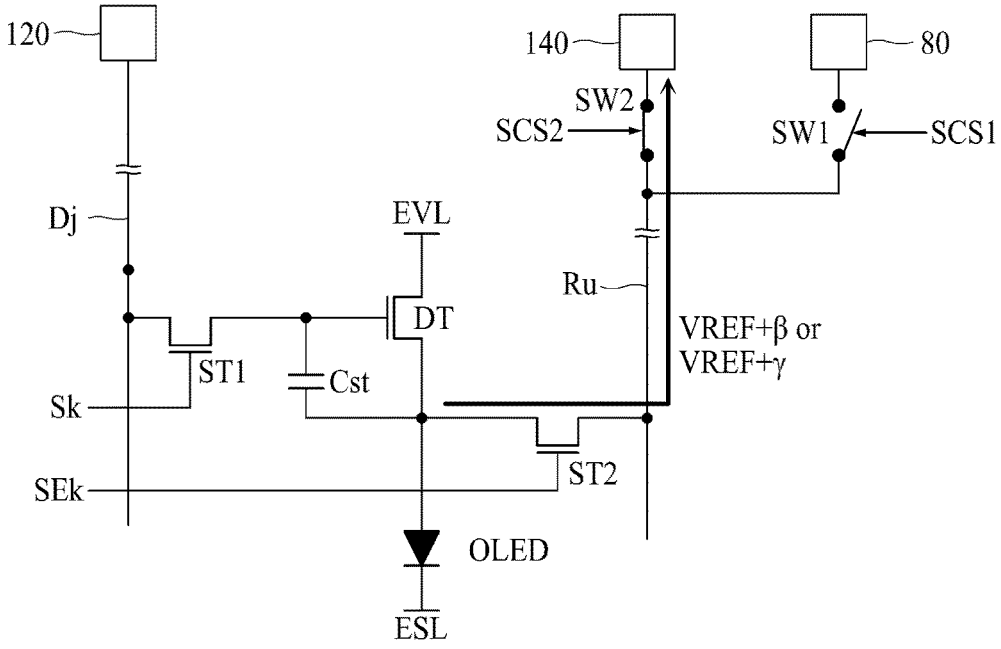

Fourthly, as shown in FIG. 14D, the first switching transistor ST1 is turned off by the kth scan signal SCANk of the gate off voltage Voff supplied to the kth scan line Sk for the fourth time period t4+. The second switching transistor ST2 is turned on by the kth sensing signal SENSk of the gate on voltage Von supplied to the kth sensing signal line SEk for the fourth time period t4+. The first switch SW1 is turned off by the first switch control signal SCS1 of the second logic level voltage V2 for the fourth time period t4+, and the second switch SW2 is turned on by the second switch control signal SCS2 of the first logic level voltage V1 for the fourth time period t4+.

The driving transistor DT flow a current in accordance with the voltage Vgs between the gate and source electrodes for the fourth time period t4+, whereby the source voltage of the driving transistor DT ascends. However, the voltage Vgs2 between the gate and source electrodes of the driving transistor DT when the light emitting element EL is degraded is smaller than the voltage Vgs1 between the gate and source electrodes of the driving transistor DT before the light emitting element EL is degraded. Therefore, if the light emitting element EL is degraded for the fourth time period t4+, the ascending amount of the source voltage Vs of the driving transistor DT is smaller than the ascending amount of the source voltage Vs of the driving transistor DT before the light emitting element EL is degraded. For example, as shown in FIG. 13, the source voltage Vs of the driving transistor DT before the light emitting element EL is degraded ascends to reach ""VREF+β" for the fourth time period t4+, whereas the source voltage Vs of the driving transistor DT when the light emitting element EL is degraded may ascend to reach "VREF+γ(β>γ)" for the fourth time period t4+.

The uth reference voltage line Ru is connected to the ADC 140 due to turn-on of the second switch SW2 for the fourth time period t4+. The source electrode of the driving transistor DT is connected to the ADC 140 through the uth reference voltage lien Ru due to turn-on of the second switching transistor ST2 for the fourth time period t4+. Therefore, the ADC 140 may sense the source voltage Vs of the driving transistor DT, that is, "VREF+β" or "VREF+γ".

Meanwhile, since the driving voltage of the light emitting element EL ascends in the third sensing mode as the light emitting element is degraded, the source voltage of the driving transistor DT ascends, whereby the voltage Vgs between the gate and source voltages of the driving transistor DT becomes smaller. If the voltage Vgs between the gate and source voltages of the driving transistor DT becomes smaller, the ascending amount of the source voltage Vs of the driving transistor DT becomes smaller for the fourth time period t4+. In this case, if the sensing voltage range of the ADC 140 in the third sensing mode is the same as that of the ADC 140 in the second sensing mode, the source voltage Vs of the driving transistor DT, which is sensed in the third sensing mode, may get out of the sensing voltage range of the ADC 140.

For example, the reference voltage VREF may be set to 0V, and the sensing voltage range of the ADC 140 may be set to 0.5V to 3.5V as shown in FIG. 12. If the light emitting element EL is degraded excessively, the source voltage Vs of the driving transistor DT, which is sensed for the fourth time period t4+ in the second sensing mode, may not exceed 0.5V. In this case, the ADC 140 senses the source voltage Vs of the driving transistor DT at 0.5V which is a lower limit of the sensing voltage range even though the source voltage Vs of the driving transistor DT is smaller than 0.5V, whereby degradation of the light emitting element EL cannot be compensated normally.

However, in the aspect of the present disclosure, since the source voltage Vs of the driving transistor DT, which is sensed in the third sensing mode, is a voltage equal to or more than the reference voltage VREF, a lower limit of the sensing voltage range of the ADC 140 in the third sensing mode is set to a voltage equal to or less than the reference voltage VREF. As a result, in the aspect of the present disclosure, the source voltage Vs of the driving transistor DT may be prevented from getting out from the sensing voltage range of the ADC 140.

In more detail, in the aspect of the present disclosure, the sensing voltage range of the ADC 140 may be set between a third low voltage VL3 equal to or less than the reference voltage VREF and a third high voltage VH3 higher than the reference voltage VREF in the third sensing mode. The ADC 140 may receive the third low voltage VL3 and the third high voltage VH3 from the voltage supply unit 80 to set the sensing voltage range in the third sensing mode.

Figure 15:
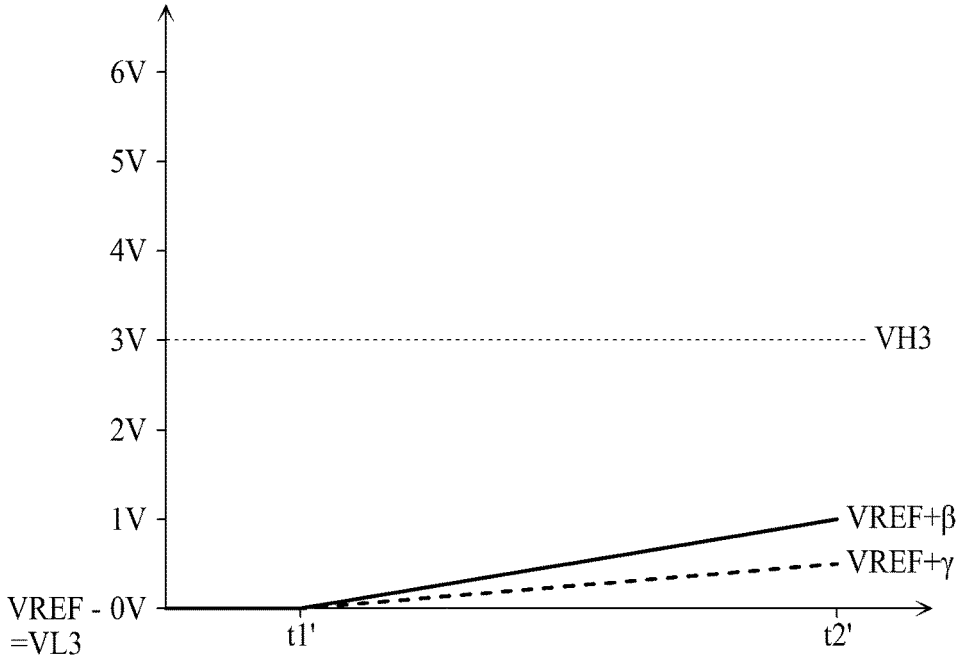
FIG. 15 is a graph illustrating an example of a sensing voltage range of an analog-to-digital converter in a third sensing mode.

For example, as shown in FIGS. 12 and 15, the reference voltage VREF of the third sensing mode and the reference voltage VREF of the second sensing mode are substantially set equally to each other, wherein the third low voltage VL3 may be set equally to the reference voltage VREF of the third sensing mode, and the reference voltage VREF of the second sensing mode may be set to be lower than the second low voltage VL2. For this reason, the third low voltage VL3 may be set to be lower than the second low voltage VL2, and the third high voltage VH3 may be set to be lower than the second high voltage VH2. That is, to prevent the source voltage Vs of the driving transistor DT from getting out from the sensing voltage range of the ADC 140 in the third sensing mode, the third low and high voltages VL3 and VH3 may be different from the second low and high voltages VL2 and VH2. In FIG. 15, the reference voltage VREF and the third low voltage VL3 of the third sensing mode are, but not limited to, 0V and the third high voltage VH3 is, but not limited to, 3V.

Figure 16:
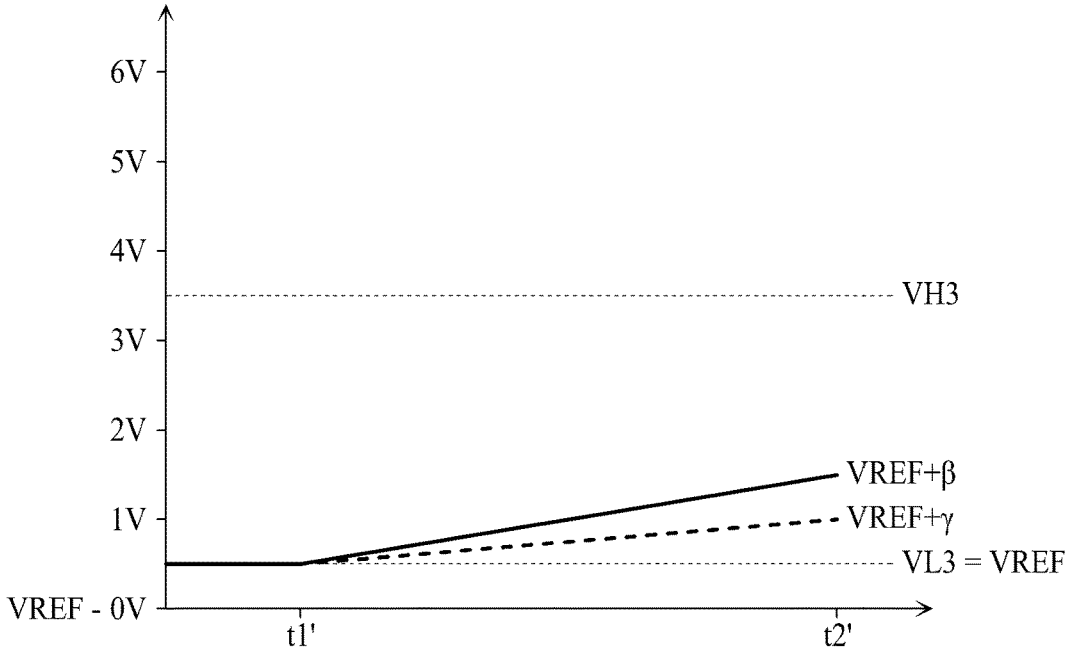
FIG. 16 is a graph illustrating another example of a sensing voltage range of an analog-to-digital converter in a third sensing mode.

Alternatively, as shown in FIGS. 12 and 16, the reference voltage VREF of the third sensing mode is set to be higher than the reference voltage VREF of the second sensing mode, and the third low voltage VL3 is substantially set equally to the reference voltage VREF of the third sensing mode, and the reference voltage VREF of the second sensing mode may be set to be lower than the second low voltage VL2. For this reason, the third low voltage VL3 may be set to a voltage equal to or more than the second low voltage VL2, and the third high voltage VH3 may be set to a voltage equal to or more than the second high voltage VH2. That is, to prevent the source voltage Vs of the driving transistor DT from getting out from the sensing voltage range of the ADC 140 in the third sensing mode, the reference voltage VREF of the third sensing mode may be set to be higher than the reference voltage VREF of the second sensing mode. Also, as shown in FIGS. 9 and 12, since the reference voltage VREF of the first sensing mode is substantially equally to the reference voltage VREF of the second sensing mode, the reference voltage VREF of the third sensing mode may be set to be higher than the reference voltage VREF of the second sensing mode. In FIG. 16, the reference voltage VREF and the third low voltage VL3 of the third sensing mode are, but not limited to, 0.5V and the third high voltage VH3 is, but not limited to, 3.5V.

In addition, a difference between the upper limit and the lower limit of the sensing voltage range of the ADC 140 may be set equally in the first to third sensing modes. In FIGS. 9, 12, 15 and 16, the difference between the upper limit and the lower limit of the sensing voltage range of the ADC 140 is, but not limited to, 3V.

As described above, according to the aspect of the present disclosure, since the source voltage of the driving transistor, which is sensed in the degradation compensation mode for compensating for degradation of the light emitting element, is the voltage equal to or more than the reference voltage, the lower limit of the sensing voltage range of the ADC in the degradation compensation mode is set to the voltage lower than the reference voltage. As a result, in the aspect of the present disclosure, the source voltage of the driving transistor may be prevented from getting out from the sensing voltage range of the ADC.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A light emitting display device comprising:

a display panel connected to data lines, scan lines and reference voltage lines and provided with pixels, each pixel including a light emitting element;

an analog-to-digital converter (ADC) converting voltages sensed from the pixels through the reference voltage lines into sensing data; and a voltage supply unit supplying a reference voltage to the reference voltage lines and supplying a third low voltage and a third high voltage to the ADC in a degradation compensation mode for compensating for degradation of the light emitting element, wherein the reference voltage in the degradation compensation mode is equal to or higher than the third low voltage.

2. The light emitting display device of claim 1, wherein the voltage supply unit supplies a second low voltage and a second high voltage to the ADC in a mobility compensation mode for compensating for electron mobility of a driving transistor of each pixel.

3. The light emitting display device of claim 2, wherein the third low voltage is lower than the second low voltage, and the third high voltage is lower than the second high voltage.

4. The light emitting display device of claim 2, wherein the reference voltage supplied to the reference voltage lines in the degradation compensation mode is higher than a reference voltage supplied to the reference voltage lines in the mobility compensation mode.

5. The light emitting display device of claim 2, wherein the voltage supply unit supplies a first low voltage and a first high voltage to the ADC in a threshold voltage compensation mode for compensating for a threshold voltage of the driving transistor of each pixel.

6. The light emitting display device of claim 5, wherein the reference voltage supplied to the reference voltage lines in the degradation compensation mode is higher than a reference voltage supplied to the reference voltage lines in the threshold voltage compensation mode.

7. The light emitting display device of claim 5, wherein the first low voltage is higher than the second low voltage, and the first low voltage is higher than the third low voltage.

8. The light emitting display device of claim 5, wherein a voltage difference between the first high voltage and the first low voltage is equal to a voltage difference between the second high voltage and the second low voltage or a voltage difference between the third high voltage and the third low voltage.

9. The light emitting display device of claim 5, wherein the first high voltage is higher than the second high voltage and the third high voltage is lower than the second high voltage.

10. The light emitting display device of claim 1, wherein the reference voltage supplied to the reference voltage lines in the degradation compensation mode is lower than the third high voltage supplied to the ADC in the degradation compensation mode.

11. A method for driving a light emitting display device comprising a display panel connected to data lines, scan lines and reference voltage lines and provided with pixels, each pixel including a light emitting element, the method comprising;

supplying a reference voltage to the reference voltage lines; and sensing voltages in the pixels between a third low voltage and a third high voltage through the reference voltage lines in a degradation compensation mode for compensating for degradation of the light emitting element and outputting sensing data, wherein the reference voltage in the degradation compensation mode is equal to or higher than the third low voltage.

12. The method for driving the light emitting display device of claim 11, further comprising:

sensing another voltages in the pixels between a second low voltage and a second high voltage through the reference voltage lines in a mobility compensation mode for compensating for electron mobility of a driving transistor of each pixel; and outputting sensing data.

13. The method for driving the light emitting display device of claim 12, wherein the third low voltage is lower than the second low voltage, and the third high voltage is lower than the second high voltage.

14. The method for driving the light emitting display device of claim 12, wherein the reference voltage supplied to the reference voltage lines in the degradation compensation mode is higher than the reference voltage supplied to the reference voltage lines in the mobility compensation mode.

15. The method for driving the light emitting display device of claim 12, further comprising:

sensing another voltages in the pixels between a first low voltage and a first high voltage through the reference voltage lines in a threshold voltage compensation mode for compensating for a threshold voltage of the driving transistor of each pixel; and outputting sensing data.

16. The method for driving the light emitting display device of claim 15, wherein the reference voltage supplied to the reference voltage lines in the degradation compensation mode is higher than the reference voltage supplied to the reference voltage lines in the threshold voltage compensation mode.

17. The method for driving the light emitting display device of claim 15, wherein the first low voltage is higher than the second low voltage, and the first low voltage is higher than the third low voltage.

18. The method for driving the light emitting display device of claim 15, wherein a voltage difference between the first high voltage and the first low voltage is equal to a voltage difference between the second high voltage and the second low voltage or a voltage difference between the third high voltage and the third low voltage.

19. The method for driving the light emitting display device of claim 18, wherein the first high voltage is higher than the second high voltage and the third high voltage is lower than the second high voltage.

20. The method for driving the light emitting display device of claim 15, wherein the reference voltage supplied to the reference voltage lines in the degradation compensation mode is lower than the third high voltage supplied to the ADC in the degradation compensation mode.

* * * * *